United States Patent [19]

Jeromin et al.

[11] 4,346,983

[45] Aug. 31, 1982

[54] XERORADIOGRAPHIC INTRAORAL DENTAL SYSTEM

[75] Inventors: Lothar S. Jeromin, Sierra Madre; Glenn F. Geddes, Alta Loma; Otto S. Baumann, Glendale; Joseph F. Santoro, Glendora, all of Calif.

[73] Assignee: Xerox Corporation, Stamford, Conn.

[21] Appl. No.: 60,074

[22] Filed: Jul. 24, 1979

[51] Int. Cl.[3] ..... G03G 15/00

[52] U.S. Cl. ..... 355/3 R; 355/3 TR; 355/14 R; 378/28

[58] Field of Search ..... 355/3 R, 3 DD, 10, 3 TR, 355/14 R, 14 TR; 250/315.1

[56] References Cited

U.S. PATENT DOCUMENTS

| | | | |
|---|---|---|---|
| 2,892,391 | 6/1959 | Mayo et al. | 355/3 R |
| 3,091,160 | 5/1963 | Crumrine et al. | 355/14 R |
| 3,435,309 | 3/1969 | Kolb et al. | 250/315.1 X |
| 3,650,620 | 3/1972 | Hoyt | 355/3 R |
| 3,672,763 | 6/1972 | Levene et al. | 250/315.1 X |
| 4,061,915 | 12/1977 | Pfeifer et al. | 250/315.1 |
| 4,118,116 | 10/1978 | Koontz et al. | 250/315.1 X |

*Primary Examiner*—Fred L. Braun

[57] ABSTRACT

An x-ray imaging system for intraoral dental radiography. The imaging process is based on xeroradiographic principles, the surface of a small photoconductive plate being electrically charged. After insertion into a carrier, to form a light-tight cassette, the photoconductive plate is placed in a patient's mouth and x-ray exposed. The cassette, and the resultant electrostatic charge image therein, is inserted into the system processor, the photoconductive plate removed and transported to a developer station wherein the image is developed using liquid toner. The toner image is then dried and transferred from the photoconductive plate by using a transparent adhesive material and fixed to a white plastic substrate, forming an image carrier wherein the image can be viewed in reflectance or transmittance. After cleaning, the photoconductive plate is available for reuse. The system has a storage compartment for receiving cleaned photoconductive plates of various sizes for subsequent insertion into an empty cassette. An output station having a device for determining the size of the empty cassette mounted therein provides a control signal which permits a cleaned plate of a predetermined size to be fed into the empty cassette. The developed xeroradiographic images are exposed and processed sequentially, processing time being approximately 20 seconds, the developed images having the characteristics of edge enhancement and deletion, the xeroradiographic images therefor having advantages over film images.

1 Claim, 39 Drawing Figures

XERORADIOGRAPHIC INTRAORAL DENTAL SYSTEM

BACKGROUND OF THE INVENTION

Xeroradiography, as disclosed in U.S. Pat. No. 2,666,144, is a process wherein an object is internally examined by subjecting the object to penetrating radiation. A uniform electrostatic charge is deposited on the surface of a xerographic plate and a latent electrostatic image is created by projecting the penetrating radiation, such as X-rays or gamma rays, through the object and onto the plate surface. The latent electrostatic image may be made visible by contacting the latent electrostatic image on the plate surface with fine powdered particles (toner) electrically charged opposite to the latent electrostatic image pattern on the plate in order to develop a positive image (in order to develop a negative image, the toner is of the same polarity as the latent electrostatic image pattern). The visible image may be viewed, photographed or transferred to another surface where it may be permanently affixed or otherwise utilized. The entire processing is dry, and no dark room is necessary.

Xeroradiography in recent years has been utilized to examine the extremities, the head, and to detect breast cancer in women. In examination of breasts wherein soft tissue comprises most of the breast area, xeroradiography, or xeromammography as it is generally called, provides greater resolving power than the conventional roentgenographic film and greater image detail is achieved. A wide range of contrast is seen on the xeroradiographic plate as compared to the conventional roentgenographic films so that all the structures of the breast from the skin to the chest wall and ribs may be readily visualized. Besides providing better contrast, xeromammography detects small structures like tumor calcification and magnifies them more than conventional film, is quicker, less expensive, gives greater detail and requires less radiation than prior nonphotoconductive X-ray techniques. The Xerox 125 system marketed by the Xerox Corporation, Stamford, Connecticut, is a commercially available apparatus for use in xeromammography.

Recent articles by Binnie et al (Application of Xeroradiography in Dentistry, *Journal Dent.*, 3:99-104, 1975) and Gratt et al (Xeroradiography of Dental Structures, I. Preliminary Investigations, *Oral Surg.*, 44:148-157, July 1977 and Xeroradiography of Dental Structures, II Image Analysis, *Oral Surg.*, 44:156-165, 1978) have described the application of the X-ray imaging in dentistry wherein the Xerox 125 system was utilized on phantoms and cadavers. The satisfactory extraoral results provided by this procedure prompted the development of an intraoral radiographic dental system based on xeroradiographic technology which would make the system acceptable to the dental profession.

This system requires a small image receptor which could be placed intraorally. A key requirement of the system would be its capability to produce images which displayed fine detail, the features of edge enhancement and the production of images which could be viewed in reflected light. Further, it is desired to provide a dental imaging system wherein the X-ray dosage requirements are substantially reduced from that used with conventional film and wherein the resultant visible images are produced is less than 30 seconds compared to the typical time of approximately 30 minutes for a conventional hand processed film image.

SUMMARY OF THE PRESENT INVENTION

The present invention provides novel xeroradiographic apparatus for dental intraoral use. The apparatus employs the same general principles of xeroradiography previously known but incorporates a number of modifications thereto, including the development process, the latter modification resulting in images with improved image detail.

In the dental xeroradiography system of the present invention, the image receptor consists of a photoconductive member, or plate, having a photoconductive layer thereon which is uniformly charged, the plate being inserted into a carrier member, forming a light tight cassette. In this sensitized state, the cassette is equivalent to an unexposed film pack. The cassette is preferably placed in a plastic bag and then inserted into a patient's mouth and exposed. The x-rays generate a latent charge image which, after the cassette is placed into the processor, is made visible with a liquid toner. The toner image on the plate surface is then dryed and lifted off the plate by means of transparent adhesive tape. Lamination of the tape to a translucent backing material fixes the image which is now available for viewing. The plate is thereafter sterilized with UV radiation, cleaned of residual toner and exposed to light to erase any residual charges.

More specifically, the photoconductive plate is formed by vacuum depositing a thin layer of photoconductive material, such as selenium, on a metal substrate utilizing standard techniques. The plate is sensitized in the processor charging station by depositing a uniform positive charge on its surface with a corona emitting device. The charged selenium surface is protected from light exposure by placing a light tight x-ray transparent shield, hereafter called the carrier, over the selenium surface to form a light tight cassette. After charging, the cassette is inserted into a thin polyethylene bag to protect the cassette and plate from saliva. After proper positioning in the mouth, exposure is made by an x-ray device. The x-rays which penetrate the oral structures discharge the photoreceptor surface proportionally to the incident radiation, a latent image composed of an array of positive electric charges representing the object densities remaining on the plate after exposure.

After exposure, the latent charge image is made visible through an electrophoretic development process using liquid toner. In its simplest form, electrophoretic development is defined as migration to and subsequent deposition of toner particles suspended in a liquid on an image receptor under the influence of electrostatic field forces. Electrophoretic developers are usually suspensions of very small toner particles in a dielectric fluid, typically an isoparaffinic hydrocarbon. Depending on the materials used and the formulation of the suspensions, the toner particles may take on a positive or negative charge. Since only fringe fields extend into the developer, development will normally occur only at the edge of the step. In accordance with the novel development system of the present invention, the field is modified to achieve also broad area development by providing a biased electrode brought in close proximity to the image receptor. The combined development field is responsible for the movement and deposition of toner to form the developed images. A pump draws the liquid developer from a reservoir and continually recirculates it through the liquid fountain adjacent the surface of photoconductive plate. The liquid flow over the development electrode is laminar, thus having the appearance of a standing wave. Image development is accomplished by traversing the plate at a constant velocity through the standing wave, development time being varied with plate velocity. Since the toner particles must be uniformly suspended in the liquid, constant stirring of the developer is provided. To achieve consistent image density, the solids carried out by the plates are replenished automatically with a closed loop concentration control system. The optical density of the fluid is continually measured electro-optically through a glass cell and compared against a reference value. When the fluid density declines below a predetermined level, an electric impulse opens a solenoid valve to a concentrate reservoir allowing concentrate to flow into the developer.

After completion of development, the plate proceeds along a track to an air manifold where drying of the image is initiated. As the plate traverses over the air stream, the excess fluid is squeegeed by an airknife to the side of the plate where porous pads absorb it, final drying being accomplished by means of evaporation.

In transfer of the toner images, the adhesive side of a transparent adhesive tape is rolled onto the image with moderate pressure, thus trapping the particles. With the top layer firmly held by the tape adhesive, virtually all toner is lifted off the plate when the adhesive tape is peeled off, the tackiness of the tape preventing relative motion between transfer tape and plate, thereby preserving image fidelity.

To permanently fix the image, the adhesive side is laminated to a white, grain-free plastic backing strip. The backing strip, a white translucent material in combination with the adhesive side, forms a novel image member which allows viewing of the image in reflected or transmitted light. Transfer and lamination is a dynamic process synchronized with plate velocity, a second image being transferred while the first image is laminated. After lamination, a single image or a strip of images is cut off automatically by activating a cutting mechanism. After leaving the transfer station, the plate traverses beneath a UV source mounted in a parabolic mirror, the generated radiant energy being sufficiently high for effective sterilization.

All residual toner is removed from the plate with a rotating foam roll contacting the plate. To minimize mechanical abrasion and to improve cleaning efficiency, the cleaning foam roll is kept wet by a second foam roll that is partially submerged in the developer fluid to supply the cleaning roll with a metered amount of fluid. The metering concept assures a thin fluid film on the plate which evaporates rapidly without leaving drying marks. A post-cleaning incandescent light is provided to erase all charges that have not been eliminated during development, drying, transfer and cleaning. Cleaning and erasing complete the image process cycle, the plate being placed into storage waiting to be reused.

The technologist interfaces with the imaging system of the present invention as follows:

(1) A carrier is inserted into the output station of the processor where a plate is automatically inserted into the carrier to form the light tight cassette which then is placed in a plastic bag.

(2) The cassette is placed in a holder and positioned in a patient's mouth.

(3) The x-ray generator is energized.

(4) The cassette is removed from patient's mouth and the plastic bag is discarded.

(5) The first cassette is inserted into the input station of the processor described hereinafter where the plate is automatically removed from the carrier for processing.

(6) The second cassette is loaded and then bagged, etc.

In contrast to film, xeroradiographic images formed in accordance with the present invention are processed sequentially, the first image being available for viewing approximately 20 seconds after insertion of the cassette into the input station.

BRIEF DESCRIPTION OF THE DRAWINGS

For a better understanding of the invention as well as further features thereof, reference is made to the following description which is to be read in conjunction with the following figures wherein:

FIGS. 20A-1, 20A-2, 20A-3, 20A-4, 20B-1, 20B-2, 20B-3, 20B-4, and 20C are logic flow diagrams for the dental processor system of the present invention.

DESCRIPTION OF THE PREFERRED EMBODIMENT

Figure 1:
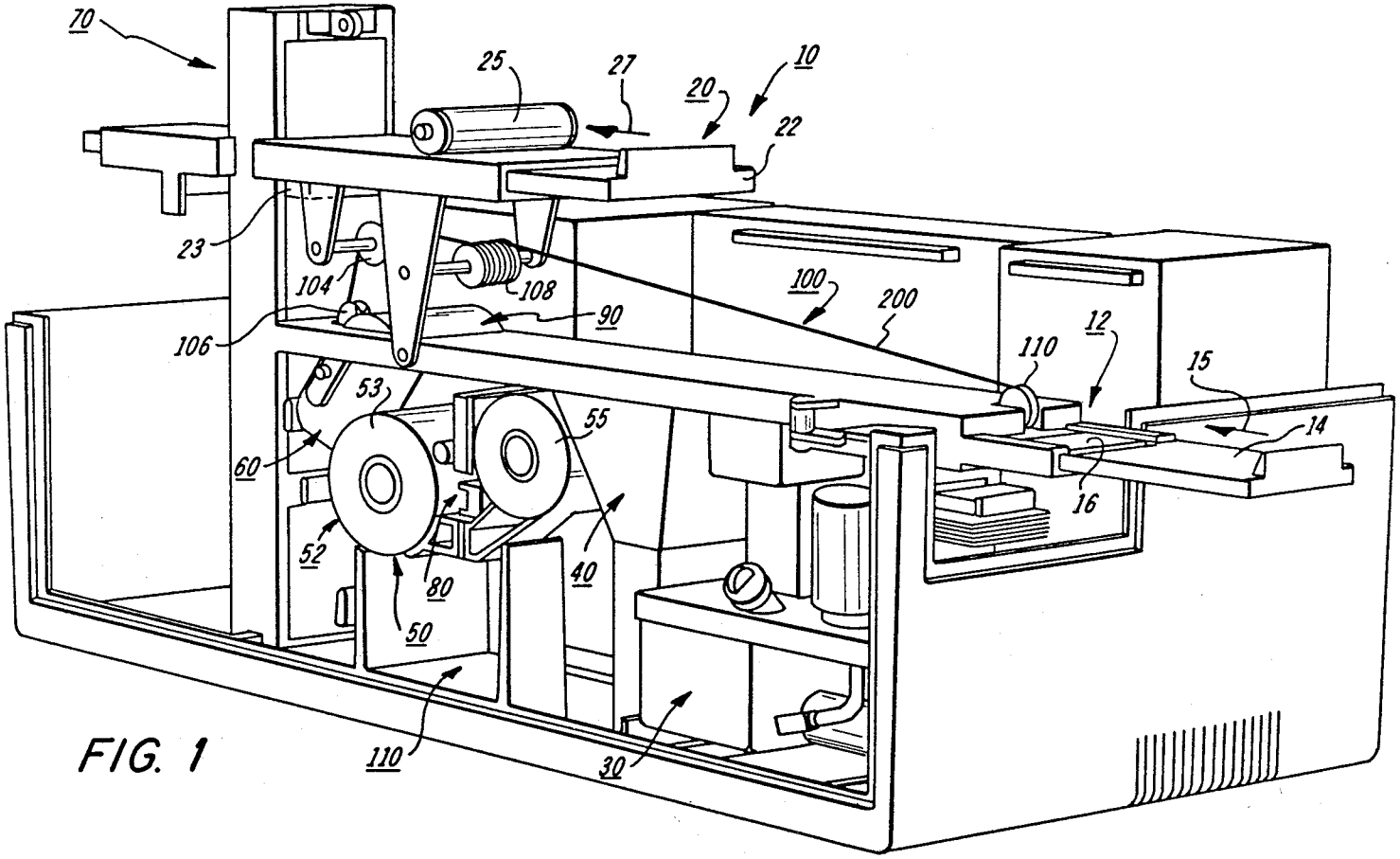
FIG. 1 is a perspective view of the novel intraoral dental processor system of the present invention.

FIG. 1 is a perspective view with some covers removed of the processor portion 10 of the intraoral dental system in accordance with the teachings of the present invention. It should be noted that for definitional purposes, the intraoral dental system is meant to include operative steps external to processor 10 as will be set forth hereinafter. The apparatus which forms the present invention comprises the processor 10 and the novel cassette to be described hereinafter.

The processor input station 12 comprises a slide type mechanism 14 (similar to a coin slot in a vending machine) shown with a cassette 16 ready for development and partially inserted into the processor 10. The output station 20 also comprises a slot type mechanism 22 wherein the carrier portion of the cassette 16 is inserted into the processor 10 to receive a charged photoconductive plate and a charging unit 23, unit 23 comprising a U-channel having corona and screen wires formed therein in accordance with standard xerographic scorotron charging techniques. An adhesive coated cylindrical roll 25 is provided as shown to pick up any lint which may be on or in the carrier portion of the cassette 16 as the slide mechanism is pushed into position.

Figure 3:
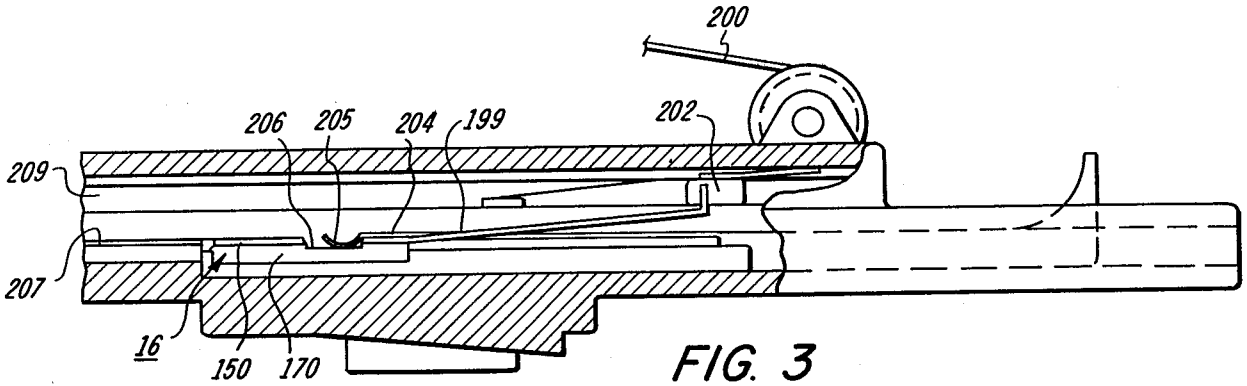
FIG. 3 is a sectional view showing a portion of the plate and plate path within the processor.
Figure 4:
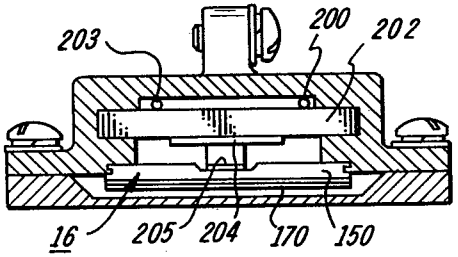
FIG. 4 is an end sectional view of FIG. 3.
Figure 5A:
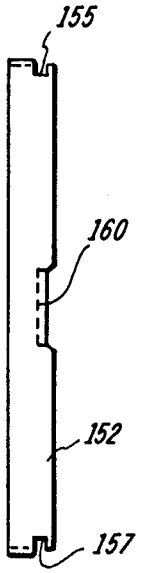
FIGS. 5(*a*)–5(*d*) show the photoconductive plate utilized in the present invention.
Figure 5B:
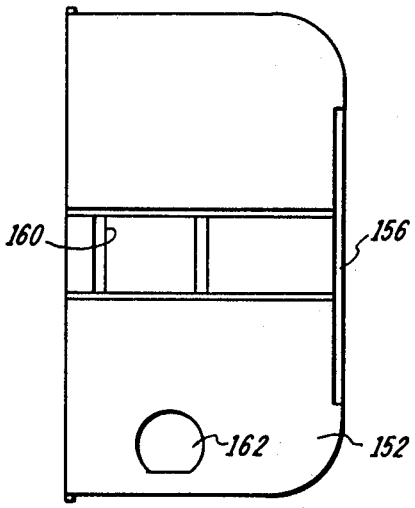
Figure 5C:
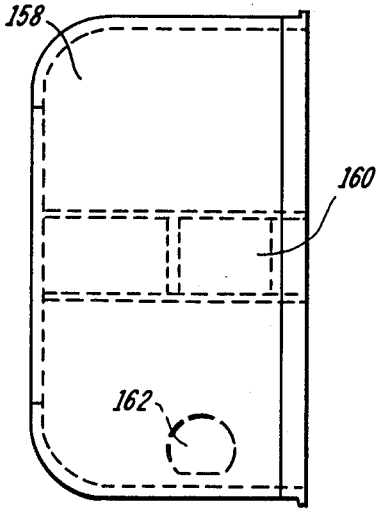
Figure 5D:
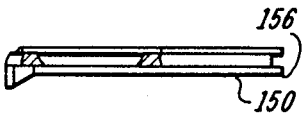
Figure 6A:
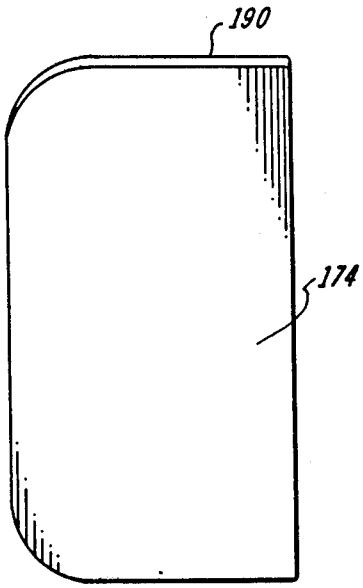
FIGS. 6(*a*)–6(*e*) show the carrier portion of the cassette of the present invention.
Figure 6B:
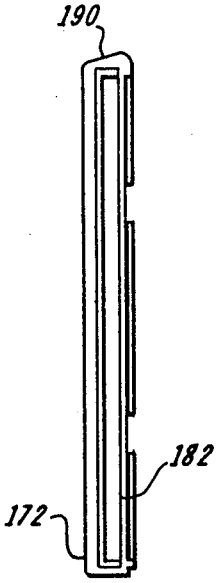
Figure 6C:
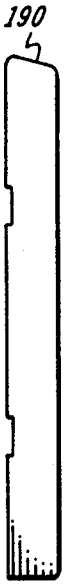
Figure 6D:
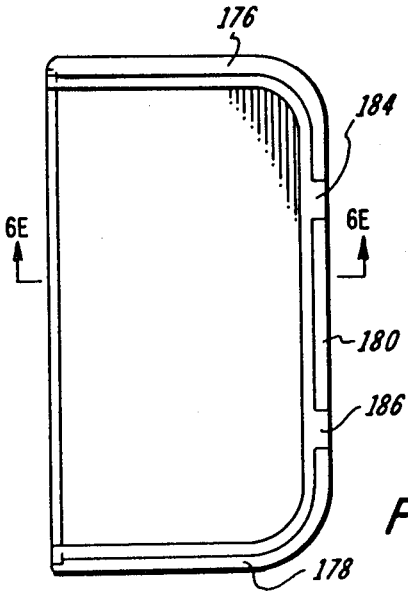
Figure 6E:
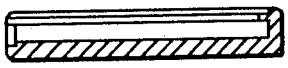

The development station is indicated by reference numeral 30, the drying station by reference numeral 40, the transfer station by reference number 50 (including the tape and backing material cartridge 52), the cleaning station by reference numeral 60, the elevator station by reference numeral 70 and the cutting station by reference numeral 80. Each of the above stations will be described in more detail hereinafter. The sequence of making an image is as follows: the carrier member portion of cassette 16 is inserted into the output station slide mechanism 22, the slide being pushed by an operator in the direction of arrow 27. A pusher motor (not shown), the pusher motor shaft being mechanically coupled to a pushing mechanism associated with the elevator station 70, is activated whereby a selected photoconductive member in the elevator station 70 is forced out from an elevator slot in a direction such that the surface of the photoconductive member is exposed to the scorotron 23 as it is pushed into the carrier portion of the cassette 16. The charged plate, it should be noted, is equivalent to an unexposed dental film utilized in present intraoral examinations. In the system of the present invention, since the photoconductive plate member and carrier will be reused, the cassette 16 is inserted into a plastic bag before insertion into the patient's mouth to protect the cassette from saliva and bacteria (the carrier portion of the cassette portion is sterilized outside the processor 10). After the plate member is exposed to X-rays (generated by any standard X-ray unit, such as the General Electric 1000 dental X-ray unit, manufactured by the General Electric Company, Milwaukee, Wisconsin), the bag is discarded and the cassette is placed in the input slot of slide 14, slide 14 being pushed in the direction of arrow 15 to activate the development process. The plate member is then removed from the cassette 16 by a second drive mechanism 100, shown in more detail in FIGS. 3 and 4, wherein drive cable 200 coupled to a driver member 202 having a metallic finger-like projection 204 thereon is illustrated. The arc-shaped end portion 205 of projection 204 is positioned in a recess 206 formed on the backside of the photoconductive plate portion of the cassette and functions, inter alia, to provide electric grounding. Pusher fingers 199 drive the plate along track 207, in sequence, to the various process stations to be described hereinafter, driver 202 moving along its track 209.

An ultraviolet lamp 90 is provided for exposing the back surface of the photoconductive member portion of cassette 16 after transfer occurs for sterilization purposes prior to being inserted into a patient's mouth although the cassette is preferably enclosed by a plastic bag.

Initially, the photoconductive plate member is pushed across development station 30 wherein the latent electrostatic charge pattern on the plate surface is developed electrophoretically.

Development takes place at about 0.5 inches/sec., the plate surface being exposed to a liquid toner fountain. After the image is developed, the plate is then pushed to the drying station 40, drying being necessary since a wet toner image on the plate cannot be successfully transferred using the adhesive tape transfer technique utilized at the transfer station 50. An angled airknife is provided, the directed air stream squeeging most of the excess developer to one side where it is absorbed by absorbing pads. To insure that the remaining toner image is dry, forced hot air is subsequently blown onto the plate. This drying function takes place as the plate continues to move through processor 10. The continually pushed dried plate is next brought to the transfer station 50. Cartridge 52, located at transfer station 50 in processor 10, contains both backing material, which is translucent, and the adhesive transfer tape in separate storage compartments 53 and 55, respectively. The plate surface having the dried toner image thereon is first brought into contact with the adhesive surface of the transfer tape. The tape is rolled onto the plate by a pressure roller (not shown) and the toner image is lifted off by virtue of the tacky material on the tape surface. Fixing of the image takes place by laminating the adhesive side of the tape having the toner image affixed thereto, to the backing material, the toner image being sandwiched between the transfer tape and the backing material. If the operator of processor 10 elects to view individual images, a knife at the cutting station 80 is activated which cuts off the image from the continuous length of the laminated sandwich, the cut image falling into output tray 110 the photoconductive member is then exposed to the ultraviolet station 720. The plate next enters into cleaning station 60 whereat the plate surface contacts a donor roller which is partially submerged in the fluid solvent used in the developer fluid to mix the developer, thereby removing any residual image. The cleaned plate is then pushed into a storage slot in the elevator 70 for subsequent reuse. As will be explained hereinafter, the elevator 70 is controlled by a microprocessor in a manner such that the plate stored in the elevator the longest time period is the one pushed into a corresponding sized carrier presently inserted into the output station slide 22.

It should be noted that the general operation of processor 10 is controlled by a microprocessor in a manner which will be described in more detail hereinafter.

Figure 2:
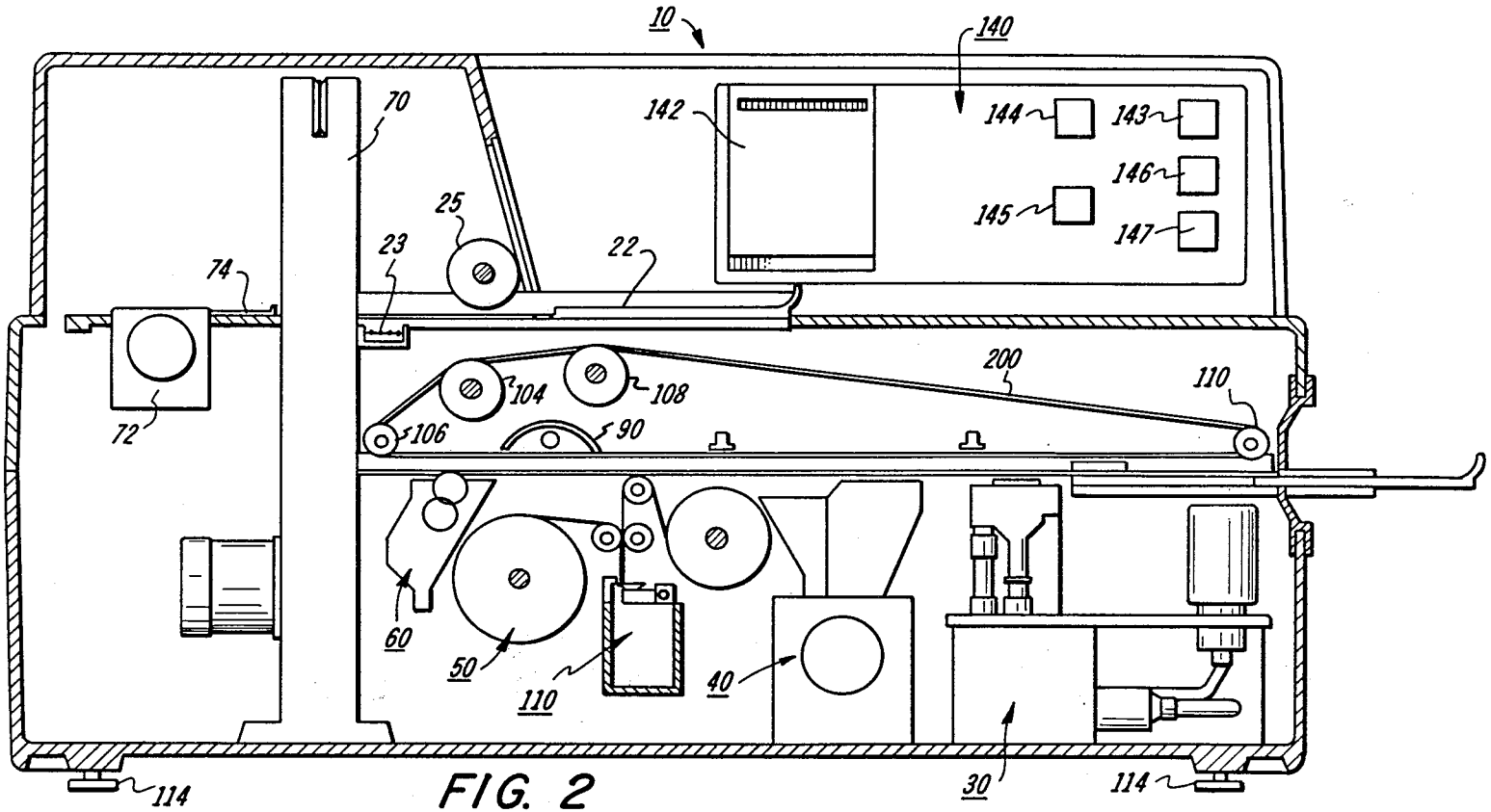
FIG. 2 is an elevation view of the system of FIG. 1 with some of the covers removed.

FIG. 2 is a simplified elevation view of processor 10 with a portion of the exterior covers removed to schematically illustrate the basic components of the processor 10. Shown in the figure is motor 72 utilized to drive an output pusher rod, or arm 74, which, as will be set forth in more detail hereinafter, is utilized to push a selected photoconductive plate stored in elevator 70 into the carrier portion inserted into output slide 22. Corona is utilized for charging the photoconductive plate as it is being forced onto the carrier portion and, in the preferred embodiment, is provided by a multi-wire scorotron. Leveling feet 114 (only two shown) may be provided to adjustably support the processor 10 on a work area selected by the operator. The drive mechanism 100 for driving driver 202 (which in turn drives the photoconductive member) includes cable 200 and pulleys 102, 104, 106 and 108. A section in control panel 140 both stores large and small carriers (two different sizes are provided, the larger size corresponding to No. 2 dental film, the smaller size corresponding to No. 1 dental film) in storage area 142; a processor 10 power on panel 143 and touch panels 144, 145, 146 and 147 showing the process status (i.e., the number of plates remaining in elevator station 70), previous plate request, bite wing or pericipical mode, plate status, and tape cutter.

FIGS. 5(*a*)–5(*d*) show various views of the photoconductive plate member 150 (small size) of the present invention. In particular, FIG. 5(*a*) is the front view of the plate, FIG. 5(*b*) is a top view; FIG. 5(*c*) is the bottom view illustrating the photoconductive surface; and FIG. 5(*d*) is a side view of the photoconductive member. The photoconductive member 150 comprises a plastic base member 152 and an aluminum substrate 156 having a photoconductive surface layer 158, typically of selenium, formed thereon. The selenium coated aluminum substrate is affixed to the plastic carrier 152 via an adhesive material (not shown). Recessed area 160 of plastic carrier 152 is cut out to expose the bottom surface of the aluminum substrate for grounding purposes and area 162 is provided to accept a reflective material. Cut out, or notch, portion 160 provides the necessary electrical grounding surface for the finger-like extension 205 on the driver 202 to engage the photoconductive plate. In the input station, the driver 202 moves along track 209 and is utilized to remove the photoconductive plate member 150 from the light tight cassette assembly inserted into slide 14 and to drive the photoconductive member 150 along plate track 207 over the various processing stations described hereinabove.

FIGS. 6(*a*)–6(*e*) show various views of the plastic carrier portion (small size) 170 of the light-tight cassette assembly described hereinabove. In particular, FIG. 6(*a*) is the bottom view of the carrier, FIG. 6(*b*) is the front view, FIG. 6(*c*) is the rear view, FIG. 6(*d*) is the top view and FIG. 6(*e*) is a sectional view of the carrier along line e—e. Carrier portion 170 comprises a unitary plastic portion 172 having a substantially flat bottom surface 174 and a vertical wall portion having side portions 176 and 178 and a rear portion 180. A rail type support member 182 extending in the horizontal plane is common to the three vertical portions and functions to support the photoconductive plate member 150 as it is inserted into the plastic carrier portion 170 by output pusher mechanism 74. Included on the rear vertical wall portion are notches 184 and 186 which function to recieve machine mounted elements for initiating the removal of the photoconductive plate member 150 from the carrier portion 170. Side wall 190 is angled as shown.

Referring back to the photoconductive plate member shown in FIG. 5, cutout area 162, in cooperation with a plurality of photosensor devices along the operative path of the photoconductive member 150, provides a means for tracking the position of the photoconductive plate member within processor 10. In particular, there is a reflective spot (aluminum tape) applied to area 162 to reflect light from a LED, the reflected light being received by a photosensor. Support member 182 on the carrier 170 is operatively slideable within recessed channel areas 155 and 157 formed on the photoconductive plate member 150.

Figure 7:
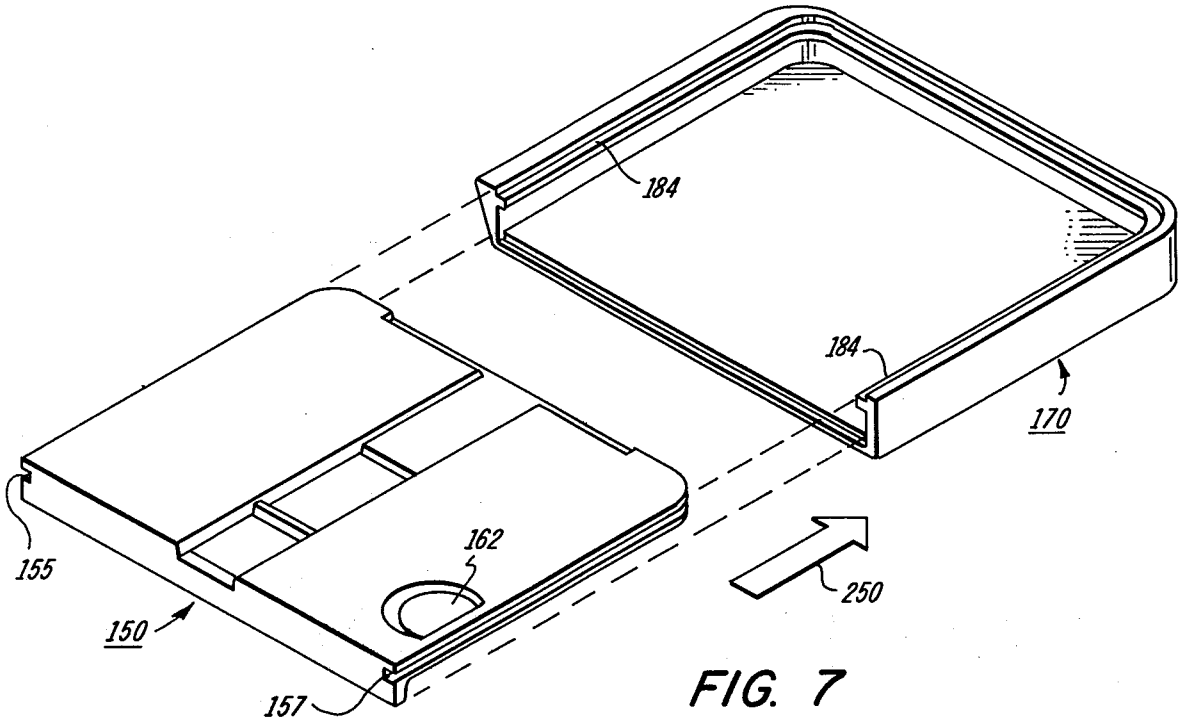
FIG. 7 is an exploded view illustrating the insertion of the plate into the carrier to form the cassette.

FIG. 7 is a perspective view of the carrier/photoconductive plate combination and illustrates how the photoconductive plate 150 is inserted into the carrier 170 to form the light-tight cassette 16. In particular, the carrier 170 is inserted into the slot in slide assembly 22 and pushed to a predetermined position adjacent the elevator station 70. The pusher motor 72 is activated when the correct position is reached and output pusher mechanism 74 is then driven towards the adjacent photoconductive plate in the elevator 70 slot forcing that plate in the direction of arrow 250 into operative engagement with carrier portion 170 to form the light-tight cassette 16. As shown, the movement of photoconductive member 150 into carrier 170 is such that the photoconductive layer surface of the plate faces into the carrier 170, the layer thereby being in a light-tight environment.

Figure 8:
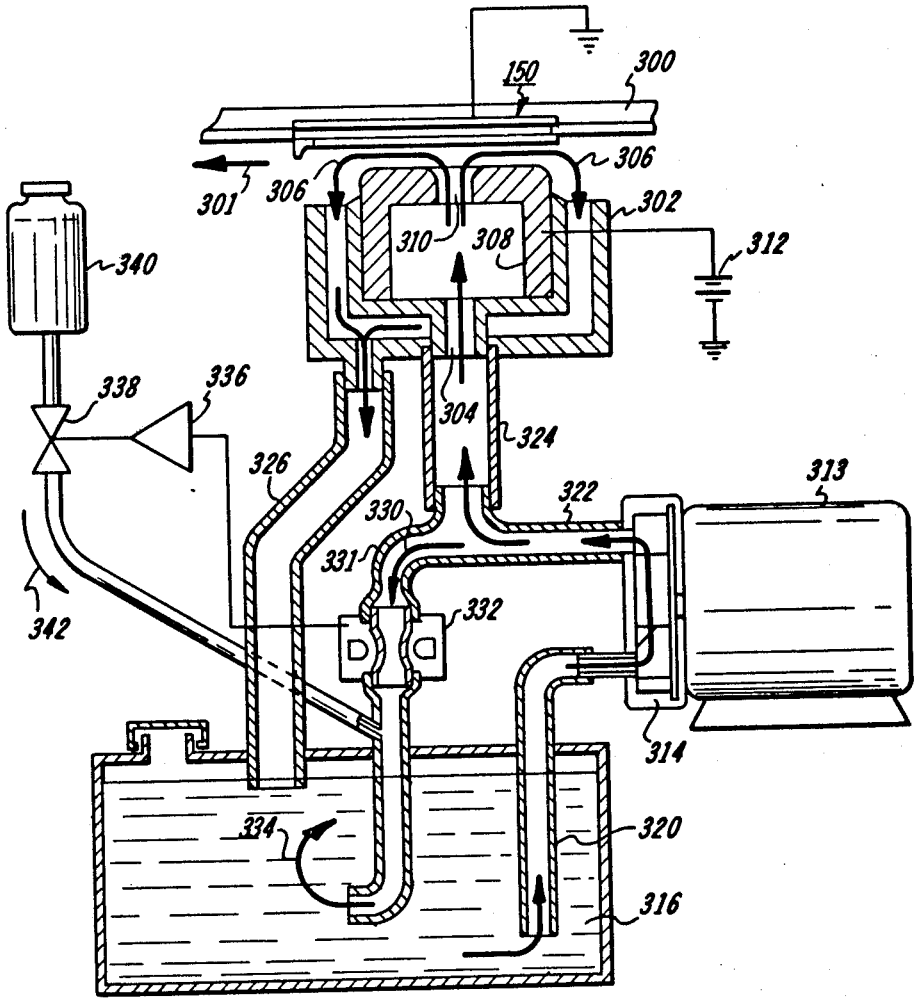
FIG. 8 is a schematic view of the developer station utilized in the present invention.

Referring to FIG. 8, a schematic representation of the liquid development system utilized in the present invention is illustrated. The photoconductive plate member 150, as set forth hereinabove, is pushed along plate track 207 by the input pusher mechanism (not shown) in the direction of arrow 301. In the illustration, the photoconductive plate surface, having the latent electrostatic charge pattern formed thereon, faces downward towards the development system as it moves through the processor 10. The conductive aluminum substrate of photoconductive member 150 is grounded during development which is accomplished by pusher finger-like extensions 205.

A rectangular shaped containment member 302 having an aperture 304 provides the liquid toner developer/flow (illustrated by arrows 306). The flow 306 is first directed through rectangular shaped development electrode 308 having an aperture 310 formed therein. A source of high voltage 312 is connected to development electrode 308 as shown.

The latent charge image on the surface of photoconductive member 150 is made visible preferably through electrophoretic development process using liquid development as herein described. As set forth hereinabove, electrophoretic development may be defined as migration to and subsequent deposition of toner particles suspended in a liquid on an image receptor under the influence of electrostatic field forces. Electrophoretic developers are typically suspensions of very small toner particles in a dielectric fluid, typically an isoparaffinic hydrocarbon. Depending on the materials used and the formulation of the suspension, the toner particles may take on a positive or negative charge. In typical xeroradiographic development situations, since only fringe fields are extending into the developer, development will normally occur only at the edge of a change in object density. Therefore, the field is modified to achieve also broad area development to the surface of the photoconductive plate 150. Biased electrode 308 superimposes a uniform electric field on the fringe field and the combined development field geometry provides for the movement and deposition of the toner particles.

The use of biased development electrode 308 biased positively in a suspension of toner particles having the same polarity as the charge image allows for negaive image development which is the same development scheme used on x-ray film. As is well-known, edge enhancement and deletion as utilized in the present invention are the most important characteristics in xeroradiographic imaging and are primarily responsible for the quality advantages of xeroradiographic images over film images. The development field and thus the degree of enhancement, deletion, broad area contrast and edge contrast can be varied to obtain optimal image quality through change of development electrode bias and spacing between development electrode and plate.

Higher electrode bias reduces enhancement and deletion width at the expense of broad area contrast. Small electrode-to-plate gap increases broad area contrast, but diminishes edge enhancement and deletion. Factors affecting image density include development time and solids concentration in the developer. Spatial resolution in excess of 20 cycles/mm have been demonstrated with liquid developers. A set of development parameters consisting of electrode bias, electrode-to-plate gap, development time and toner concentration which has produced xeroradiographic images of excellent diagnostic quality are as follows:

Electrode bias: 1600 volts, positive
Electrode-to-plate gap: 0.050 inches
Development time: 2 seconds
Toner concentration: 0.35 Optical Density Units/mm A pump 314, driven by motor 313, removes developer from reservoir 316 and continually recirculates it through the container 302 via ducts 320, 322, 324 and 326 as illustrated. The liquid flow over the development electrode is laminar, thus having the appearance of a standing wave. Image development is accomplished by traversing the plate 150 at a constant velocity through the standing wave. Development time, it should be noted, can be varied with plate velocity. Since the toner particles must be uniformly suspended in the liquid (forming the developer), constant stirring of the developer is required and is provided in the following manner. A portion 330 of the developer flow is diverted back to the reservoir 316 via duct 331 and past electro-optical sensor 332, the resultant flow 334 stirring the toner developer in the reservoir 316. To achieve consistent image density, the solids in the toner developer carried out by the developed plates have to be replenished. This is done automatically with a closed loop concentration control system. In particular, the optical density of the developer fluid 330 is continually measured electrooptically via sensor 332 and compared against a set, predetermined reference value. When the fluid density declines below the predetermined level, an electric impulse, amplified by amplifier 336, opens solenoid valve 338, valve 338 controlling a concentrate reservoir 340, thereby allowing concentrate to flow along path 342 into the developer in reservoir 316.

Liquid development of xeroradiographic dental images and tape transfer of the toner image created the process requirement of image drying prior to transfer.

Drying a xeroradiographic image in the dental application requires that the image fidelity be preserved (i.e., toner image must not be disturbed); drying marks, similar to the edges of an evaporated water drop, should not appear anywhere in the image area; and drying must occur "on the fly" to achieve the overall system throughput goals.

Figure 9A:
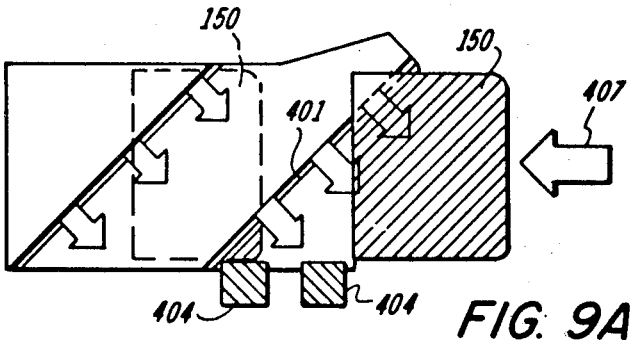
FIGS. 9(*a*) and 9(*b*) illustrate the drying station utilized in the present invention.
Figure 9B:
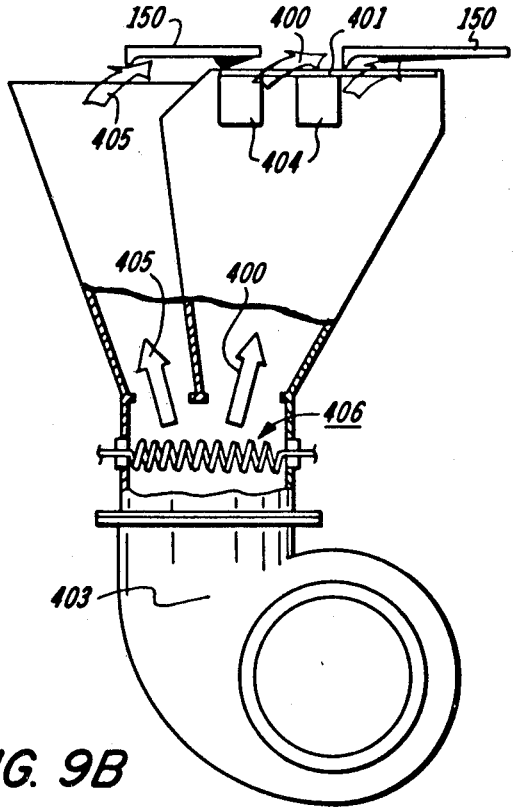

A two-step drying method which meets all three requirements is shown in FIGS. 9(*a*) and 9(*b*). To remove the excess developer fluid the image bearing photoreceptor 150 is moved over a stationary airknife. The airknife comprises a gentle stream of slightly pressured and heated air 400 coming out of a slot-like orifice 401 generated by airsource (blower) 403, the fluid being forced to the side of the photoreceptor 150 where it is either flicked off or absorbed by felt or foam pads or rolls 404. The squeeging beam of air is angled to the photoreceptor 150 as shown (preferably at an angle of 45°). Once the photoreceptor member 150 has passed the airknife, the toner image is still slightly moist. The final drying is accomplished by means of evaporation. A large volume of the heated air 405 is blown towards the image causing the toner particles and the photoreceptor surface to dry. The direction of the drying air flow is also angled to the plate path to keep any drops that might be forming at the side of the absorbing pads 404. As shown in the figure, resistive heater means 406 are provided to heat the air produced by blower 403. Plates 150 are, as illustrated, driven in the direction of arrow 407.

Figure 10:
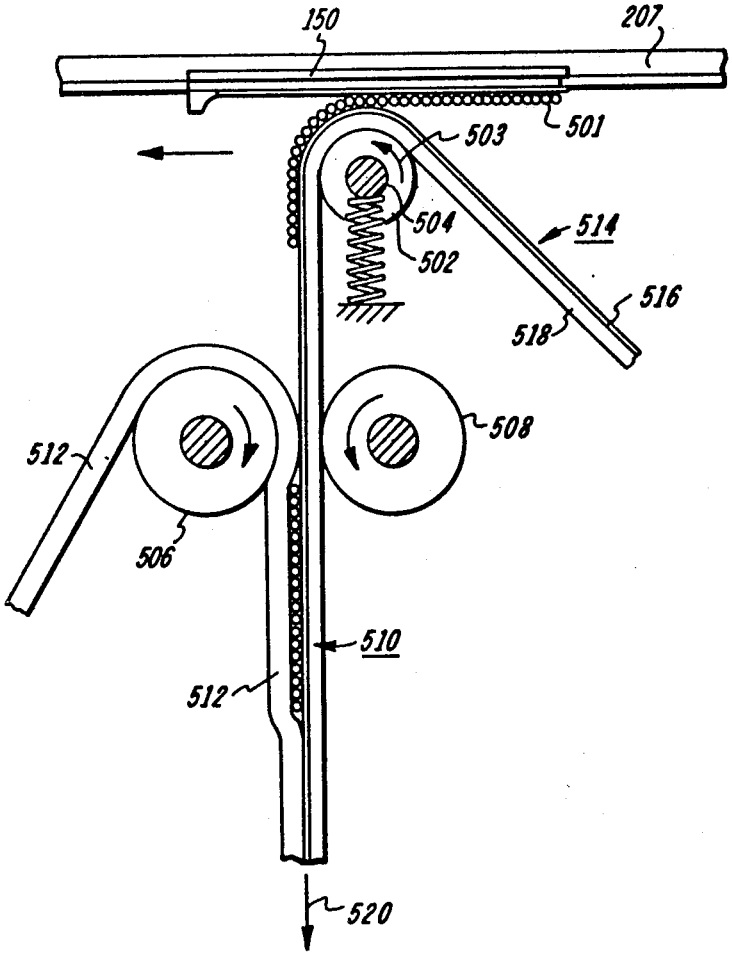
FIG. 10 is a general schematic view of the transfer station utilized in the present invention.

FIG. 10 is a simplified schematic drawing of the transfer process utilized in the present invention to transfer the toner image from the surface of the photoconductive member 150 to a receiving surface and thereafter to form a layered structure comprised of a translucent backing strip, the transferred toner image and an adhesive member.

Specifically, the photoconductive member 150 is pushed along the plate track 207 by the pushing mechanism in a continuous manner into the transfer station 50. The toner image 501 formed on the surface of the photoconductive member 150 faces a transfer pressure roll 502 which is a non-driven idler roll, rotatable in the direction of arrow 503 about shaft 504. As illustrated, transfer pressure roll 502 is, in the operative state, spring biased towards the toner image 501. If a new material 52 cartridge is to be inserted into the transfer station, the operator (by a mechanism described hereinafter) can move the transfer pressure roll 502 away from the toner image 501. A drive roll 506 and pinch roll 508 are also provided both of which are driven in the direction of the arrows. The components of the layered structure 510 referred to hereinabove comprises translucent backing strip 512 and an adhesive film member 514, the adhesive film member 514 comprising transparent adhesive portion 516 and transparent film portion 518.

In operation, with transfer pressure roll 502 in the position shown, the toner image 501 is stripped from the surface of the photoconductive member 150 and adheres to clear adhesive portion 516. As the toner containing adhesive film member 514 is driven in the direction of arrow 520 by the combined action of drive roll 506 and pinch roll 508, translucent backing strip member 512 is fed into the space between roll 506 and the toner containing surface of adhesive portion 516. The force maintained between the rolls 506 and 508 adheres the backing strip 512 to the adhesive film member 514, forming a laminated image therebetween.

As set forth hereinabove, adhesive portion 516 is rolled onto the image with moderate pressure, thus trapping the toner particles. The pressure exerted by the transfer pressure roll 502 and the adhesive penetrating the toner layers makes toner layers adhere together. With the top layer firmly held by the tape adhesive portion 514, virtually all toner is lifted off the plate surface when the adhesive film member 514 is removed therefrom. Because of the tackiness of the adhesive film portion 514 any relative motion between the tape and plate is prevented, image fidelity being fully preserved.

To permanently fix the image, the adhesive side is laminated to the white, grain-free plastic backing strip 512. The lamination process sandwiches the toner image between two durable, scratch resistant strips thus assuring archival quality. The backing strip, being a white, translucent material, allows viewing of the image in reflected or transmitted light, a convenience to the machine operator and the patient. Transfer and lamination is a dynamic process synchronized with plate velocity. Thus, while the second image is being transferred, the first image is laminated as illustrated in the figure. Since the tape is still sufficiently tacky while carrying the toner image, lamination is practically irreversible. After lamination, a single image or a strip of images is cut off automatically by the operator pushing a button which activates a cutting mechanism.

Backing strip 512 is preferably a polyester film coated with a white material (such as titanium dioxide bound in plastic) having a thickness typically in the range of from 0.005–0.006 inches thick. A typical material which may be used is Stabilene Opaque Film, manufactured by Keuffel and Esser, Morristown, New Jersey. Transfer film portion 518 of film member 514 preferably comprises an intermediate layer of clear, stable plastic film having a thickness typically in the range from 0.001–0.003 inches thick, such as Dupont's Mylar D plastic film. Transparent adhesive portion 516 is coated on one side of film 518 and preferably comprises an acrylic adhesive layer approximately 0.002 inches thick. The other side of film 518 is coated with a very thin layer of a silicone release material (not shown in the figure) to prevent the inner wound layers of film member 514 from sticking together.

Figure 11:
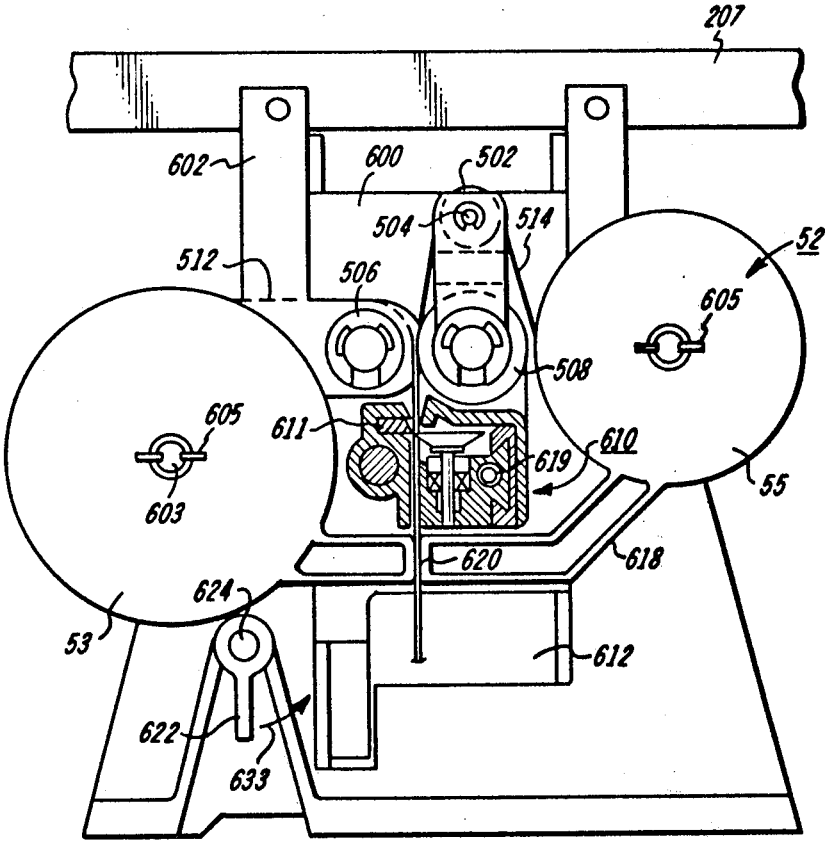
FIGS. 11 and 12 are plane views of the front and rear, respectively of the transfer and cutting station in the down position.
Figure 12:
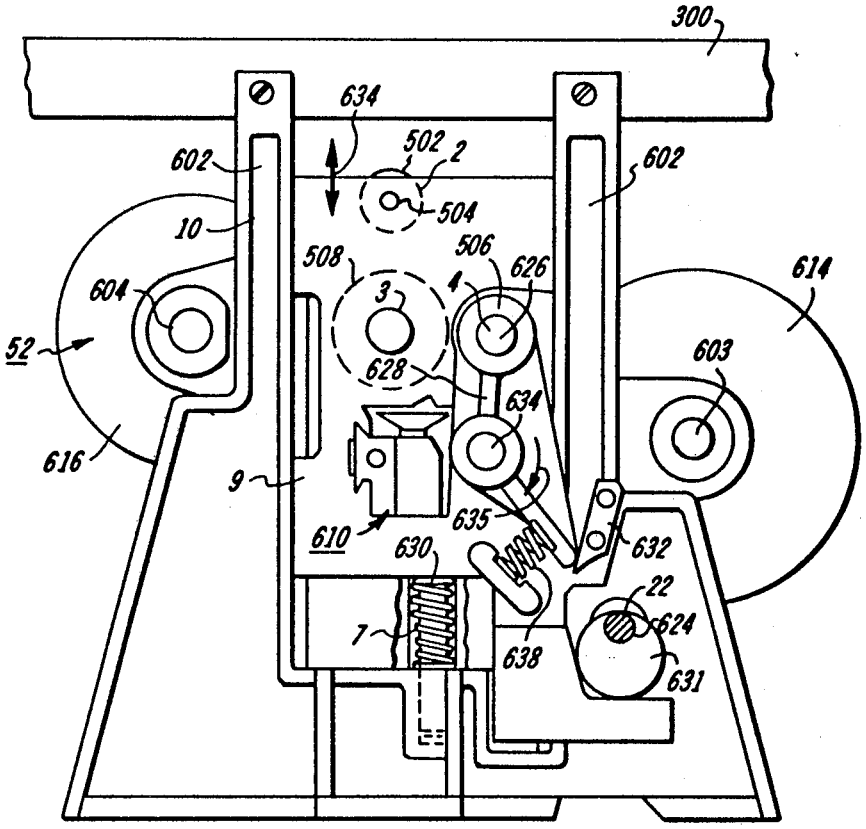

FIGS. 11 and 12 show front and rear elevation views, respectively, of the transfer station 50 in the down, or inoperative, position. Transfer station 50 includes means for locating and then locking a dental tape cartridge 52 in place and a mechanism for bringing the transfer pressure roll 502 into operative contact with the toner image 501 formed on the surface of the photoconductive plate member 150, plate member 150 being driven to the transfer station 50 along plate track 207.

The apparatus comprises a tape transfer slide assembly 600 shown positioned within a slide support 602. Locating pins 603 and 604, formed on slide assembly 600, are provided to properly locate the cartridge assembly 52 loaded with the backing tape 512 and transfer tape 514 when placed on slide assembly 600. Locking springs 605 (associated pins not being shown) enables the cartridge assembly to be locked into place after it is positioned on the locating pins 603 and 604. Drive roll 506, pinch roll 508 and transfer pressure roll 502 are affixed to the tape transfer slide assembly 600. A kife assembly 610, including a fixed knife 611, described in more detail hereinafter, allows the laminated images to be cut individually or in strips, the cut image being caught in area 110. The cartridge 52 comprises a unitary structure having storage compartments 53 and 55 for backing tape 512 and transfer tape 514, respectively, the two storage compartments being joined by an elongated portion 618. An aperture 620 for directing the laminated image into catch area 110 is provided in portion 618 as illustrated. A lever 622, rotatable about shaft 624, is provided to move transfer tape 502 into an out of engagement with laminated tape as appropriate and to facilitate loading of a new cartridge. Transfer roll shaft 504 is utilized to rotatably support transfer pressure roll 502 and pivoted pinch roll shaft 626 is utilized to pivotably support drive roll 506. A pivot mechanism 628 is mechanically coupled to drive roll shaft 626. A transfer load spring 630 is provided to maintain the transfer slide assembly 600 at a predetermined position (and therefore the transfer pressure roll 502) such that the toner image can be transferred to the adhesive layer 514. Driven pinch roll shaft 626 is affixed to slide assembly 600 and is utilized to mount the drive roll 506. An eccentric cam member 631 and linear cam member 632 provide the required mechanical action for driving the slide assembly 600 in the direction of arrows 634. A compression spring 638 compresses (holds together) drive and pinch rolls 506 and 508, respectively, in the operative mode.

In operation, and assuming that a cartridge assembly is to be loaded into the system transfer station, the operator turns lever 622 which disengages drive roll 506 and pinch roll 508 and lowers transfer roll 502 so that a leader of laminated transfer and backing tape (each tape already in place in their respective compartments) can be threaded over the transfer roll and between drive and pinch roll and then places the cartridge 52 on locating pins 603 and 604 and presses it towards slide assembly 600 to lock the cartridge assembly 52 is place. It should be noted that the cartridge assembly 52 is supplied to the system user as required. The leader (standard) preferably is added to leading edges of transfer and backing tape by the supplier. Cam member 632 is then positioned in the direction of arrow 633, thereby causing cam member 630 and spring 626 to move slide assembly 600 in the direction of arrow 634 to a predetermined position so that transfer pressure roll 502 is adjacent the toner image formed on the surface of the photoconductive member. If the cartridge 52 is to be removed; i.e., the tape therein has been depleted, cam member 632 is moved in the direction opposite to arrow 633, causing the slide assembly 600 to be retracted to an initial, or unloaded, position.

Spring 630 is biased to push slide assembly 600 towards the plate path in the operating mode. If it is desired to replace the cartridge assembly 52 already in place, lever 622 on cam 630 is rotated causing cam 630 in turn to rotate 180° thereby moving slide 600 downwards and pivots against cam 632 causing pivot 634 to rotate in the direction of arrow 635 thus separating rolls 506 and 508, lowering transfer roll 502 and allowing the leader of laminated tape in cartridge 52 to be placed over transfer roll 502 and between drive and pinch rolls 506 and 508. It should be noted that as the cartridge 52 is pushed forward over the locating pins 603 and 604, the tapes are lifted enough to form a loop allowing them to be positioned over the transfer roll 502 and rolls 506 and 508.

Figure 12A:
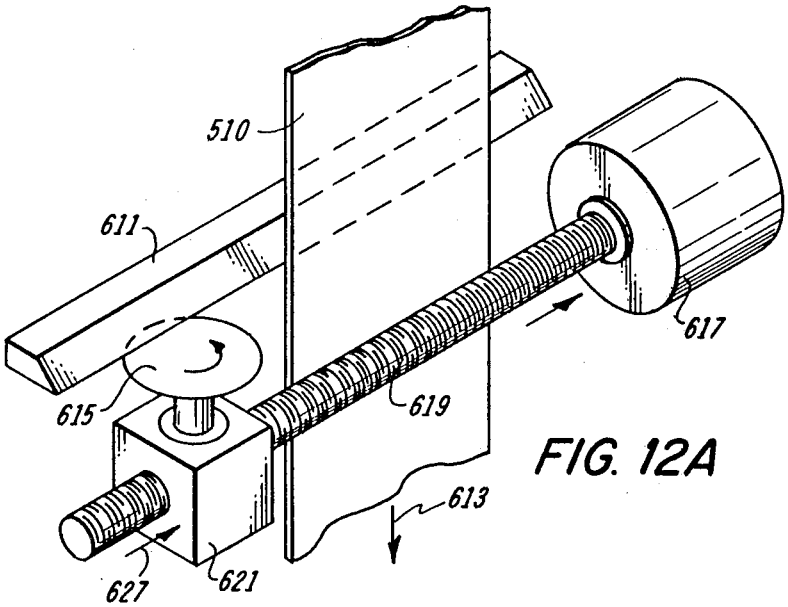
FIG. 12*a* is a perspective view illustrating the cutting station.

FIG. 12A is a simplified, perspective view of a portion of the processor cutting station 610 which is adjacent to and operatively associated with the transfer station 50 described hereinabove. The laminated tape 510, moving in the direction of arrow 613 is directed past stationary knife 611 and a rotating knife 615. A motor 617 drives a lead screw 619 which operatively drives movable member 621 which supports knife 615. Motor 617 is energized by a control panel signal, causing member 621 to move in the direction of arrow 627. Tape 510 is cut as rotating blade 615 (in cooperation with stationary knife 611) moves thereacross.

Figure 13:
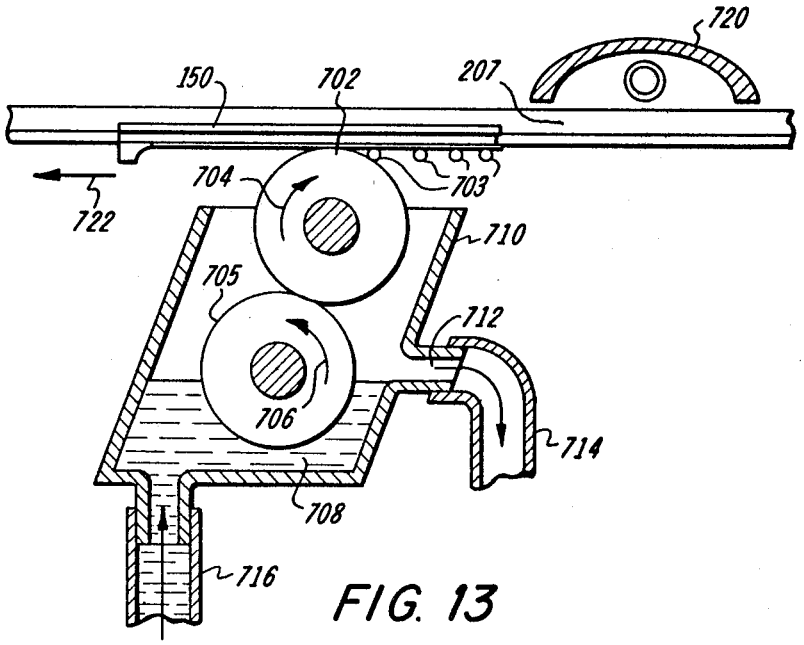
FIG. 13 is a schematic view of the cleaning station utilized in the present invention.

Although the transfer step described hereinabove removes substantially all the toner from the plate 150, some residual toner particles may remain in high density regions. The apparatus shown schematically in FIG. 13 is utilized to remove substantially all residual toner 701 from the plate. In particular, a cleaning foam roll 702, rotating in the direction of arrow 704, is brought into contact with the surface of plate 150. To minimize mechanical abrasion and to improve cleaning efficiency, the cleaning foam roll 702 is maintained in the wetted state by a second foam roll 705, rotating in the direction of arrow 706 and partially submerged in developer fluid 708. Roll 705 supplies cleaning roll 702 with a metered amount of developer fluid 708.

Rolls 702 and 705 and developer fluid 708 are maintained in housing 710. An outlet port 712 is provided as a drain to the liquid toner reservoir 316 (FIG. 8) via tubulation 714 which also determines the level of the liquid 706 within housing 710. Liquid developer 708 is supplied to housing 710 from toner reservoir 316 via tubulation 716.

In the preferred embodiment, roll 702 is driven by a motor (not shown) whereas roll 705 is an idle roll driven by the rotation of roll 702.

The metering concept described above assures a thin fluid film on the plate which evaporates rapidly without leaving drying marks. Because the preferred developer contains only a small percentage of solids by weight, it can be used successfully as cleaning fluid.

Since the photoconductive member 150 is not fully discharged at exposure and development, drying, transfer and cleaning do not fully eliminate the charge image on the plate, a post cleaning incandescent light 720 is provided to erase all residual charges which would otherwise disturb the next image on that plate.

Cleaning and erasing complete the image process cycle and the plate 150 is now conveyed along plate track 207 in the direction of arrow 722 to the elevator station 70 for storage in an elevator slot for eventual reuse.

Figure 14A:
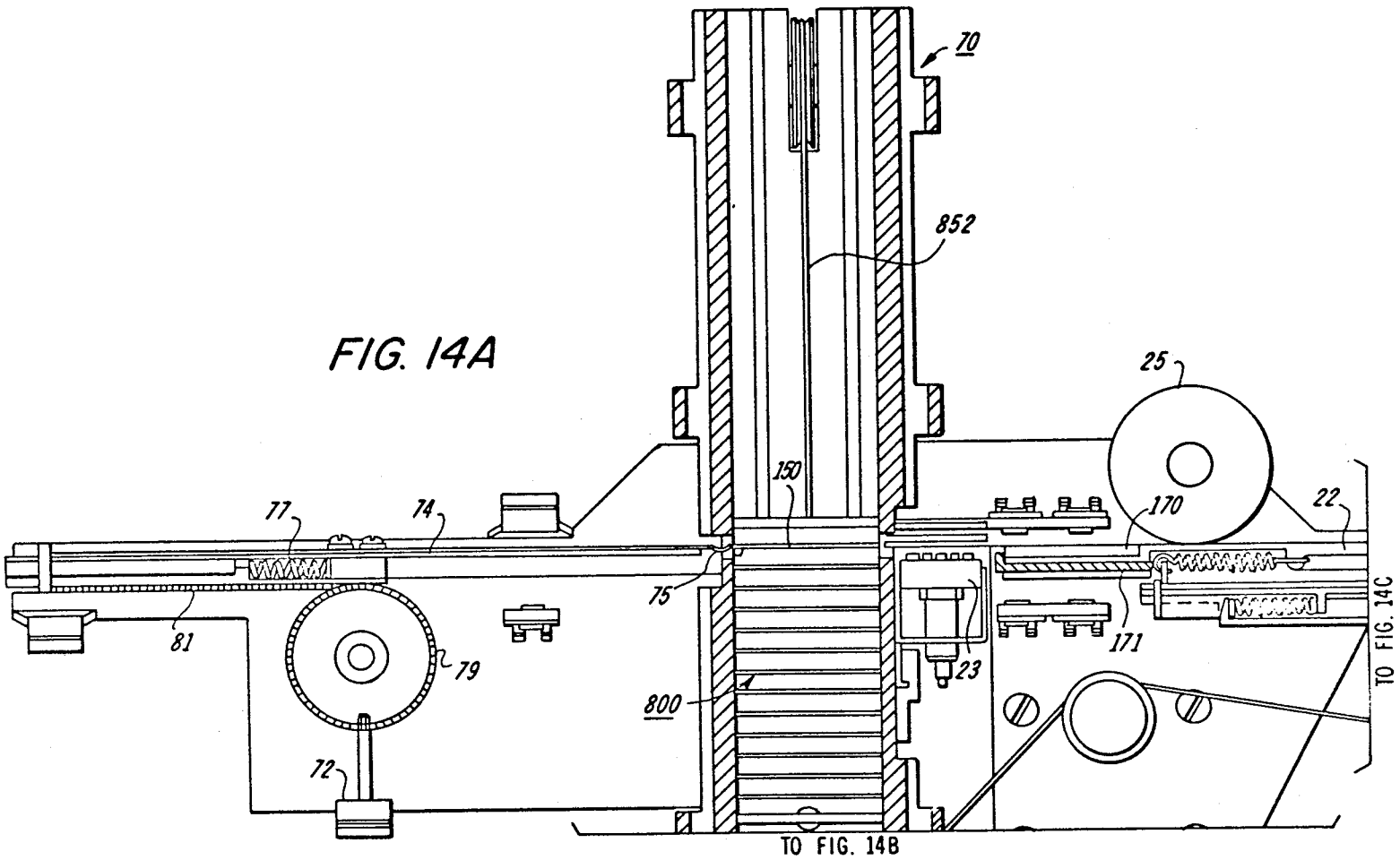
FIGS. 14(*a*)–14(*c*) are plane views illustrating the output station apparatus utilized to push a plate stored in the elevator portion into a carrier.
Figure 14B:
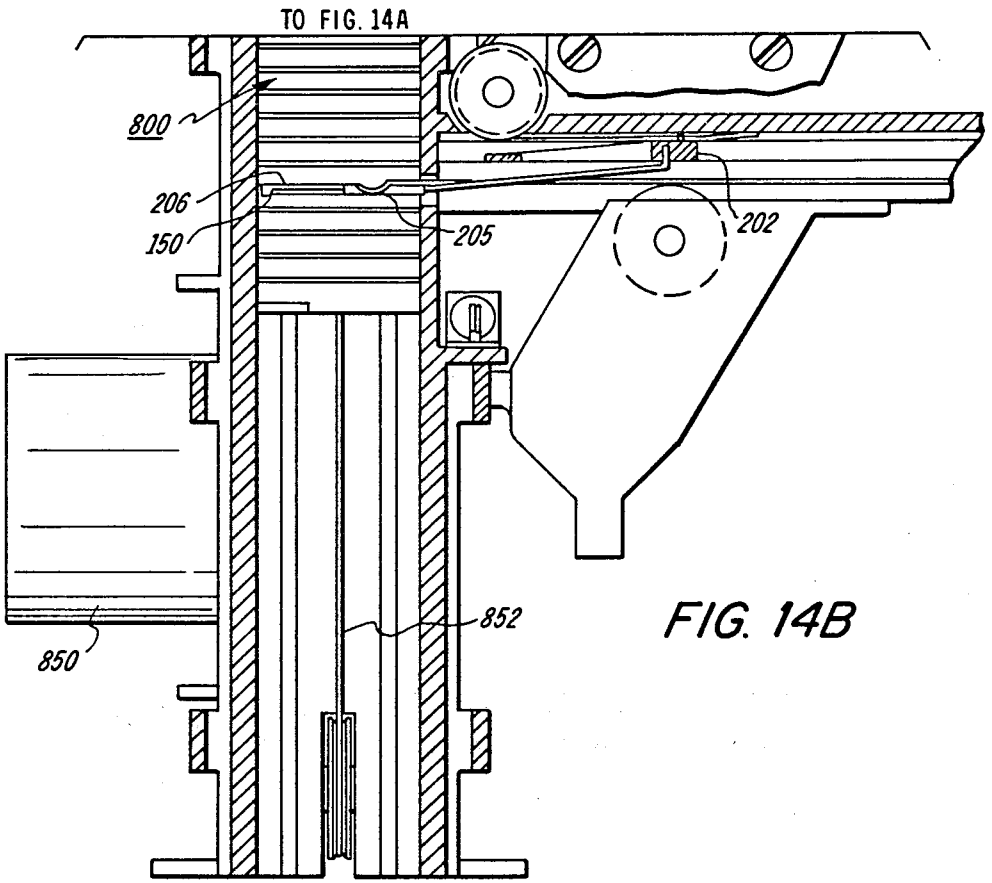
Figure 14C:
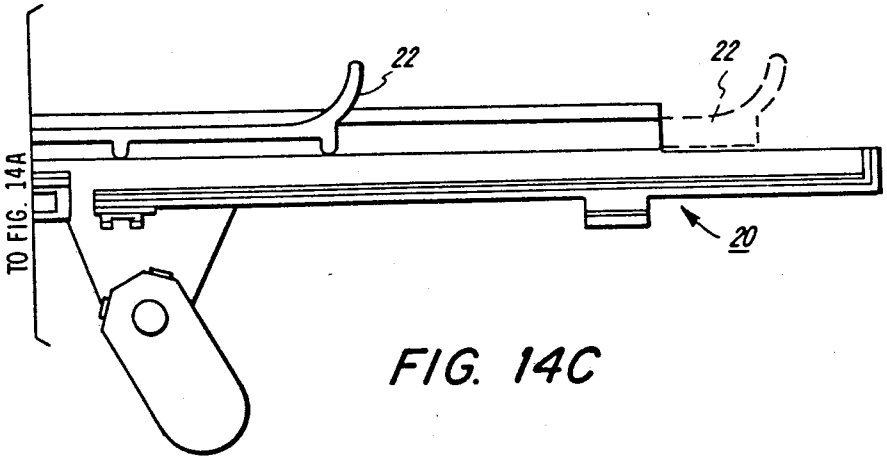

FIG. 14 illustrates in some detail the elevator and carrier loading portions of the intraoral dental system. The elevator/storage mechanism comprises a multi-slotted vertical storage member 800. As illustrated, the storage capacity of member 800 is twenty-five plates although smaller or larger capacity units could be provided. As illustrated, plate 150$^1$ has been inserted into one of the storage slots by driver member 202. Also shown in plate 150$^2$, positioned in the uppermost storage slot. Curved portion 205 of driver 202 is a ground spring which engages the cutout portion in plate 150 to provide grounding of the photoconductive substrate. Pusher, or rod mechanism 74 is biased by spring 77 toward the elevator storage compartment. When motor 72 is energized, driver mechanism 74 is forced toward the elevator 70 via a gearing arrangement comprising gear 79 and a notched driving rack 81. In this situation, pusher mechanism 74 will push on the vertical end portion of plate 150$^2$, forcing it towards a carrier 170, held in retaining channel member 171, via scorotron 23. An elevator motor 850 is provided to drive, via cable 852 and upon command of the microcomputer, storage member 800 to the appropriate position adjacent pusher mechanism 74 such that the plate of the corresponding size to the inserted carrier which has been in storage for the longest time period will be pushed into carrier 170 to form the cassette 16.

Figure 15:
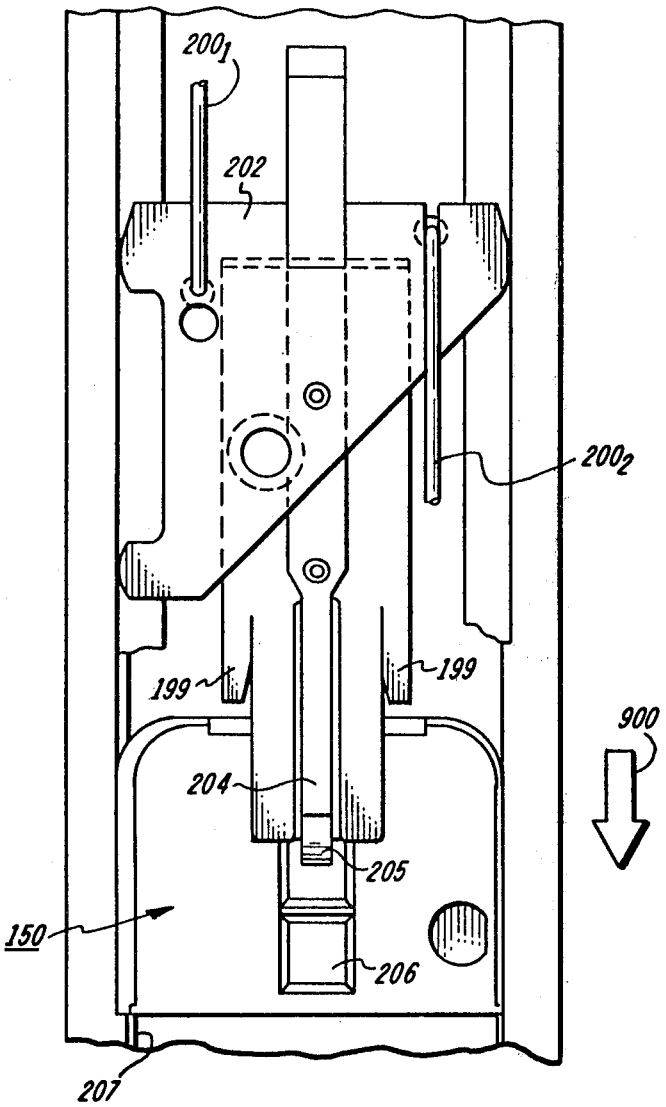
FIG. 15 illustrates, in more detail, the input station mechanism utilized to push the plate member over the processor stations.

FIG. 15 is a view illustrating how the photoconductive plate member 150 is pushed through the system along plate track 207 to the various processing stations in the direction of arrow 900. The driver mechanism, shown clearly in this figure, comprises the drive or slide 202, member 202 having cable 200 (shown as comprising portions 200$^1$ and 200$^2$) affixed thereto. Cable 200$^1$ is utilized to pull the driver 202 from top to bottom in the operative mode in the direction of arrow 900 and cable 200$^2$ is utilized to pull the driver 202 from bottom to top in the reverse mode in the direction opposite to arrow 900. The pusher fingers 199 is the member which actually pushes the plate 150 in the direction of arrow 900 in such a manner that the photoconductive surface faces downward towards the processing stations as it moves through the processor 10.

Figure 16:
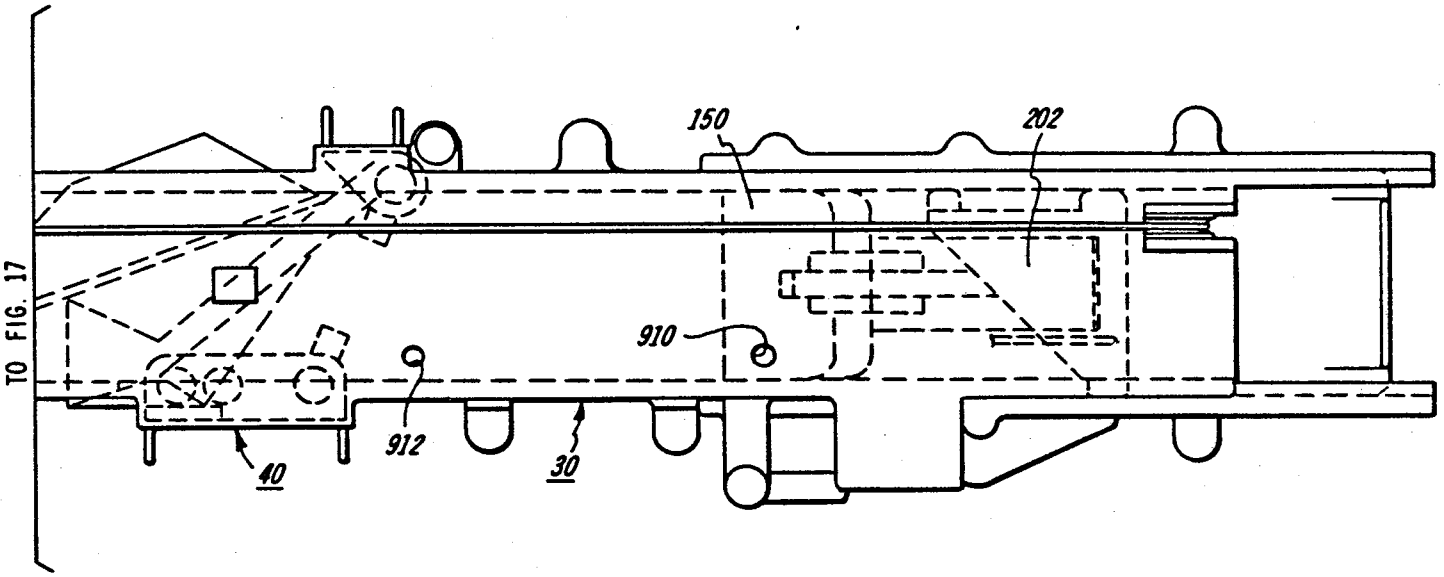
FIGS. 16–18 are plane views illustrating the overall plate path configuration.
Figure 17:
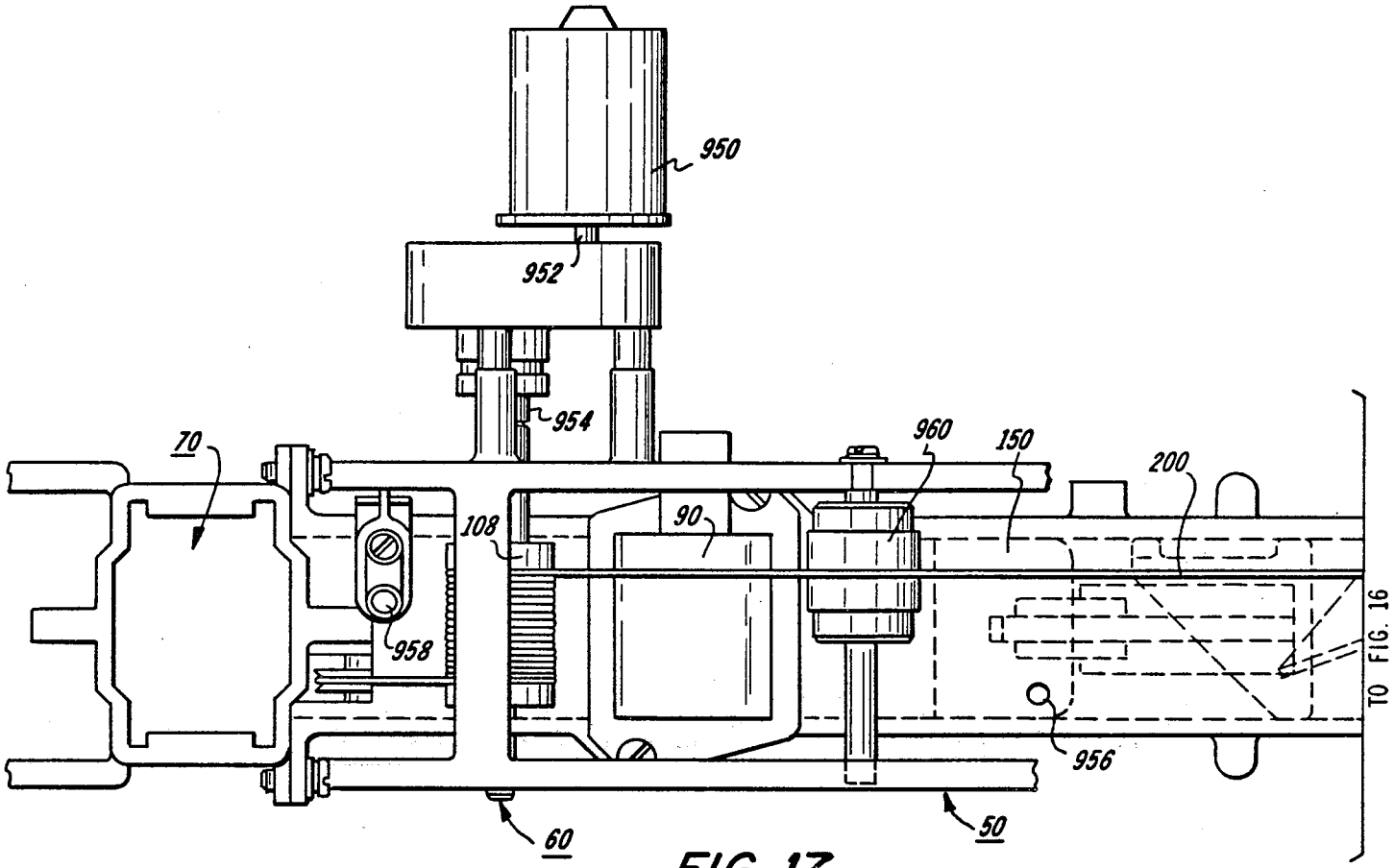
Figure 18:
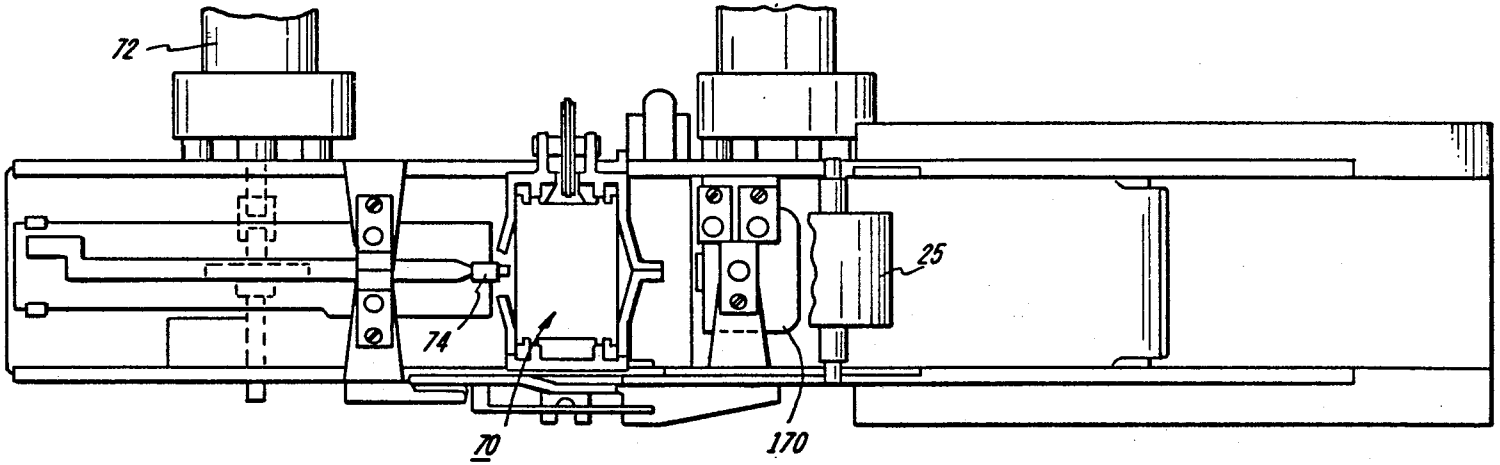
Figure 19:
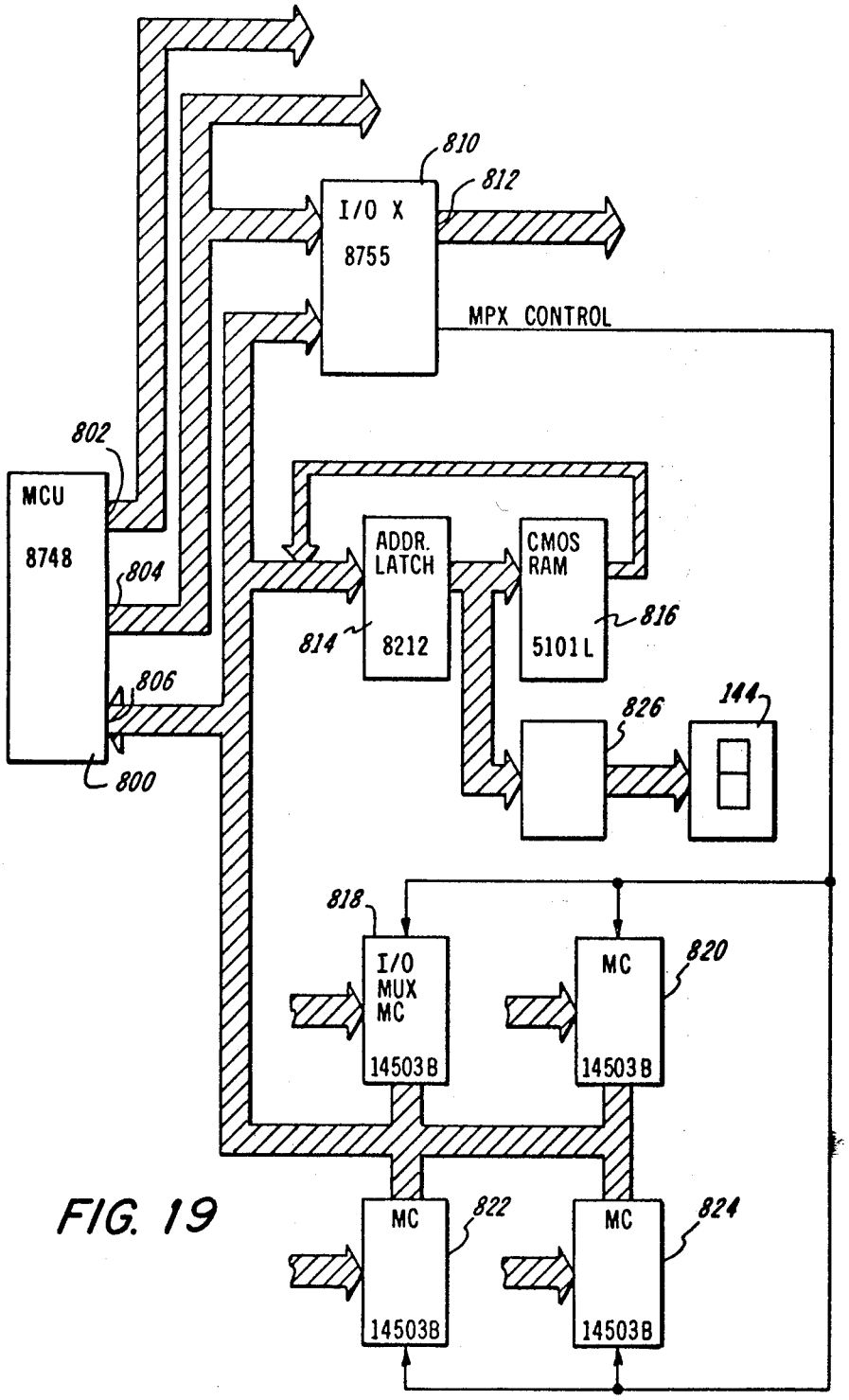
FIG. 19 is a block diagram of the microcomputer controller utilized in the present invention.
Figures 1, 20A:
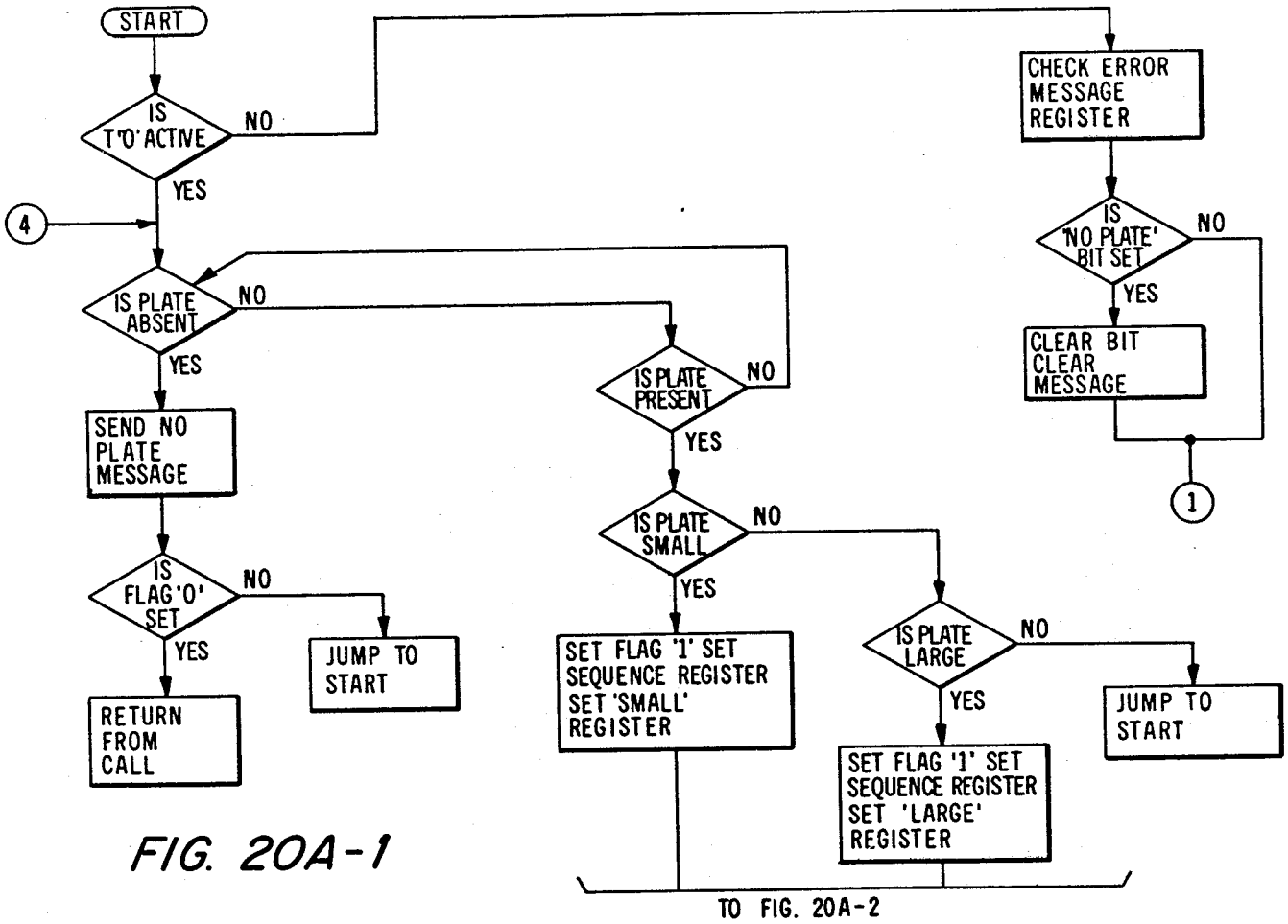
Figures 2, 20A:
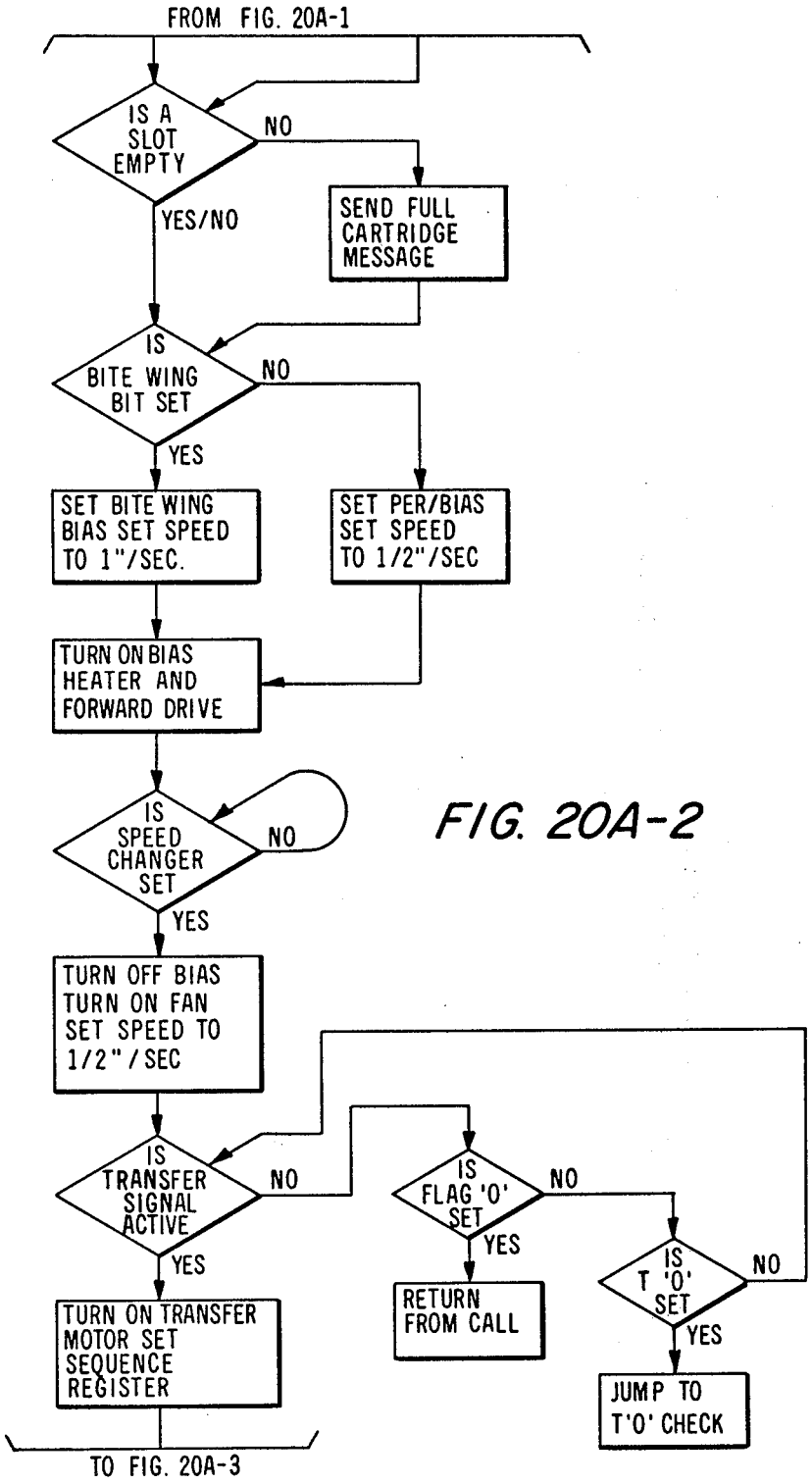
Figures 3, 20A:
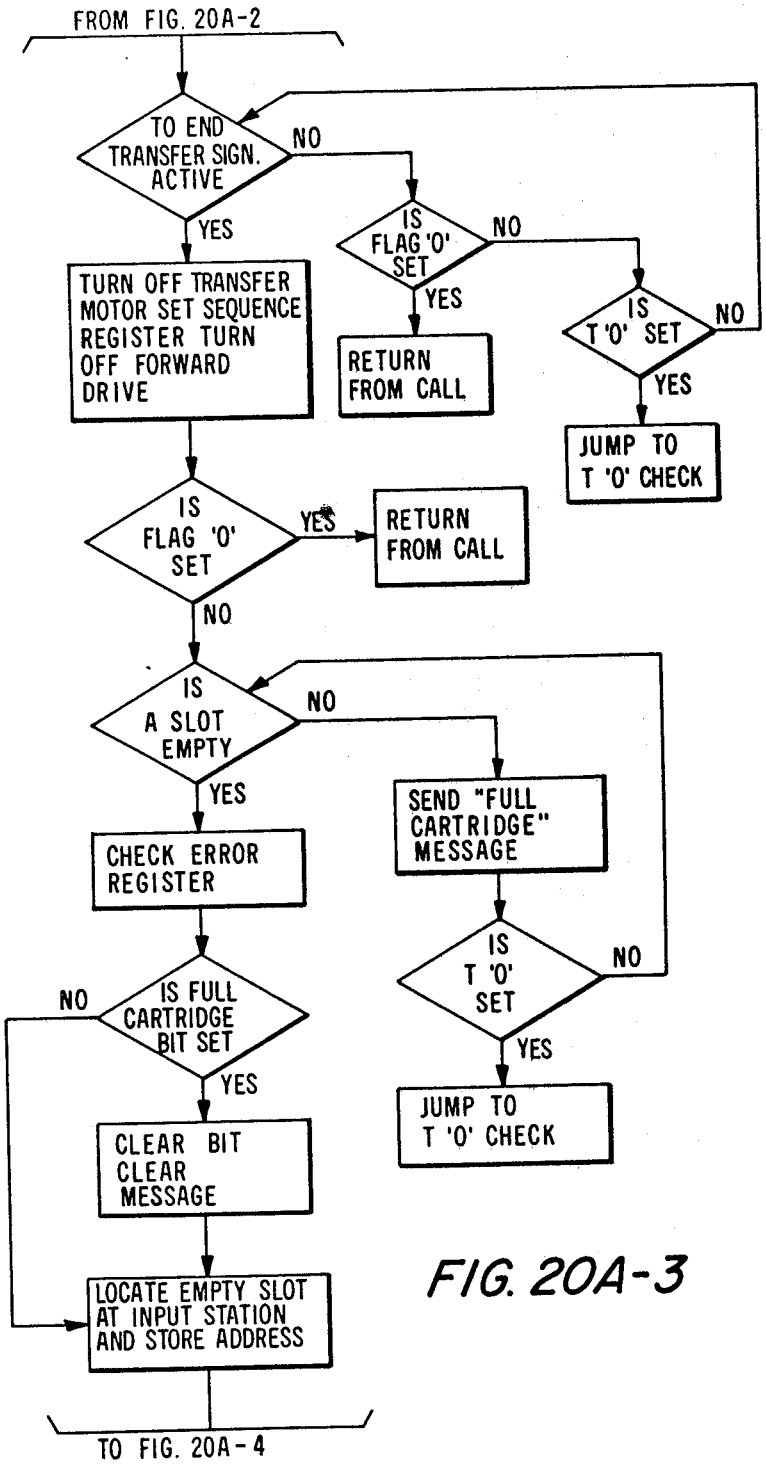
Figures 4, 20A:
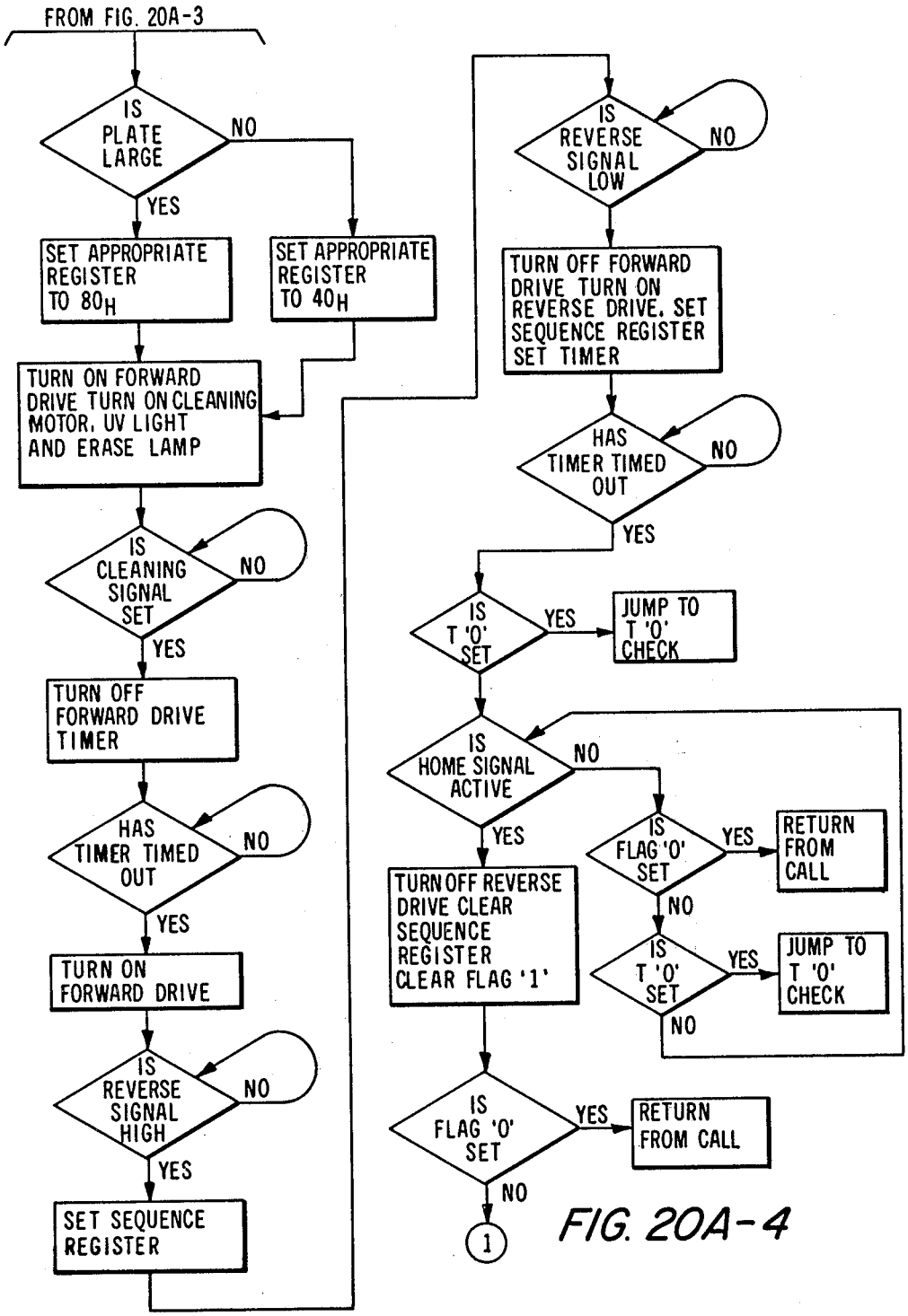
Figures 1, 20B:
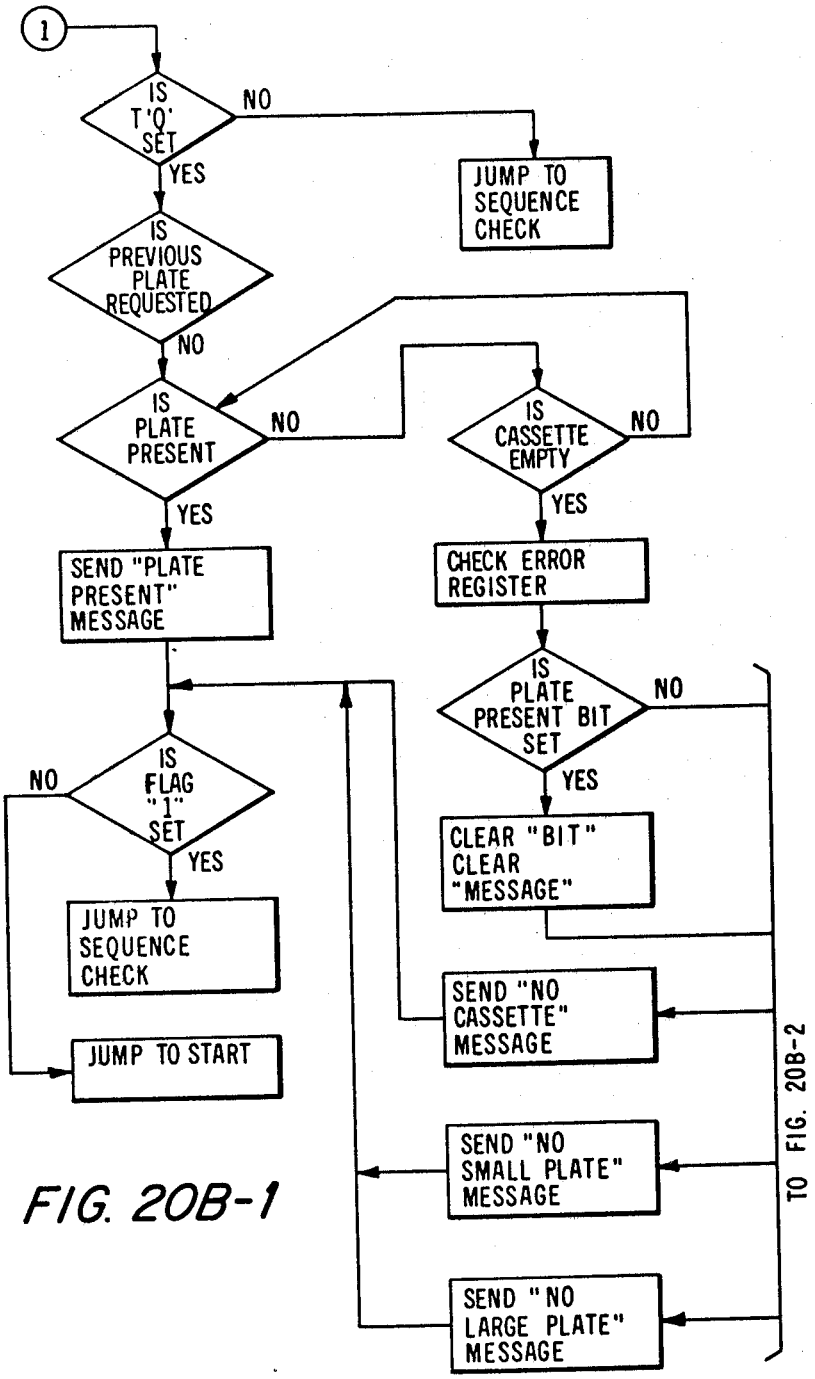
Figures 2, 20B:
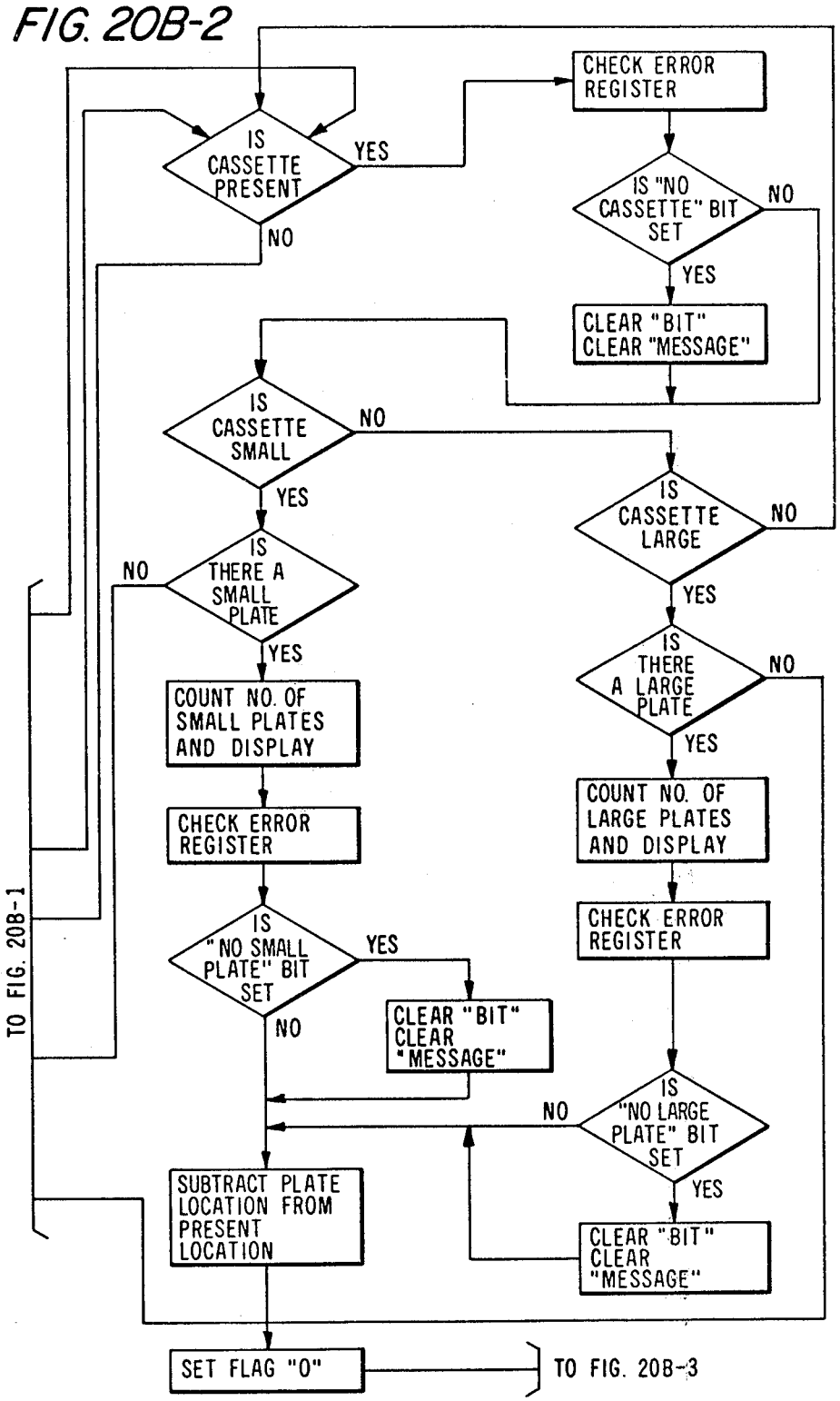
Figures 3, 20B:
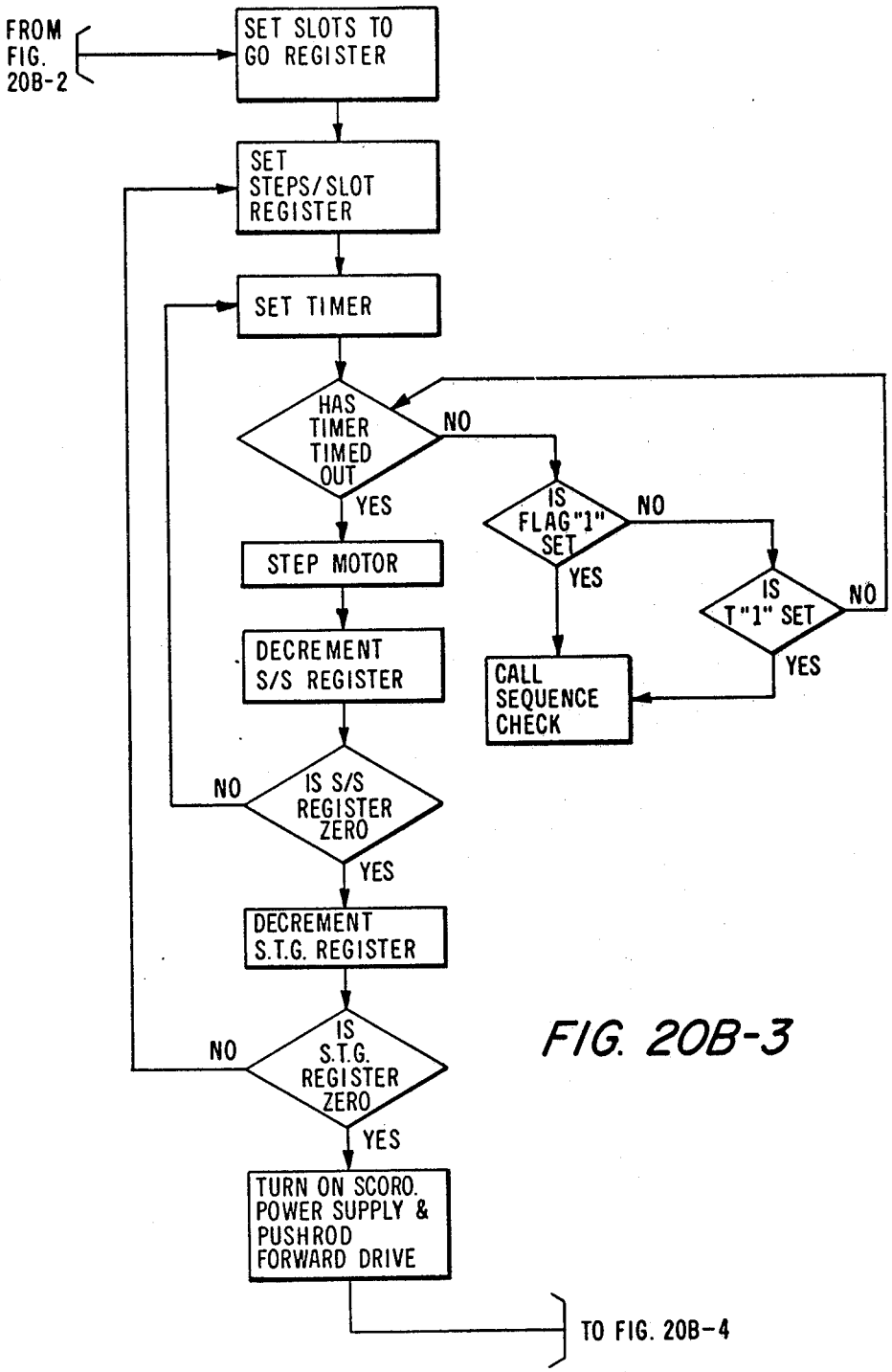
Figures 4, 20B:
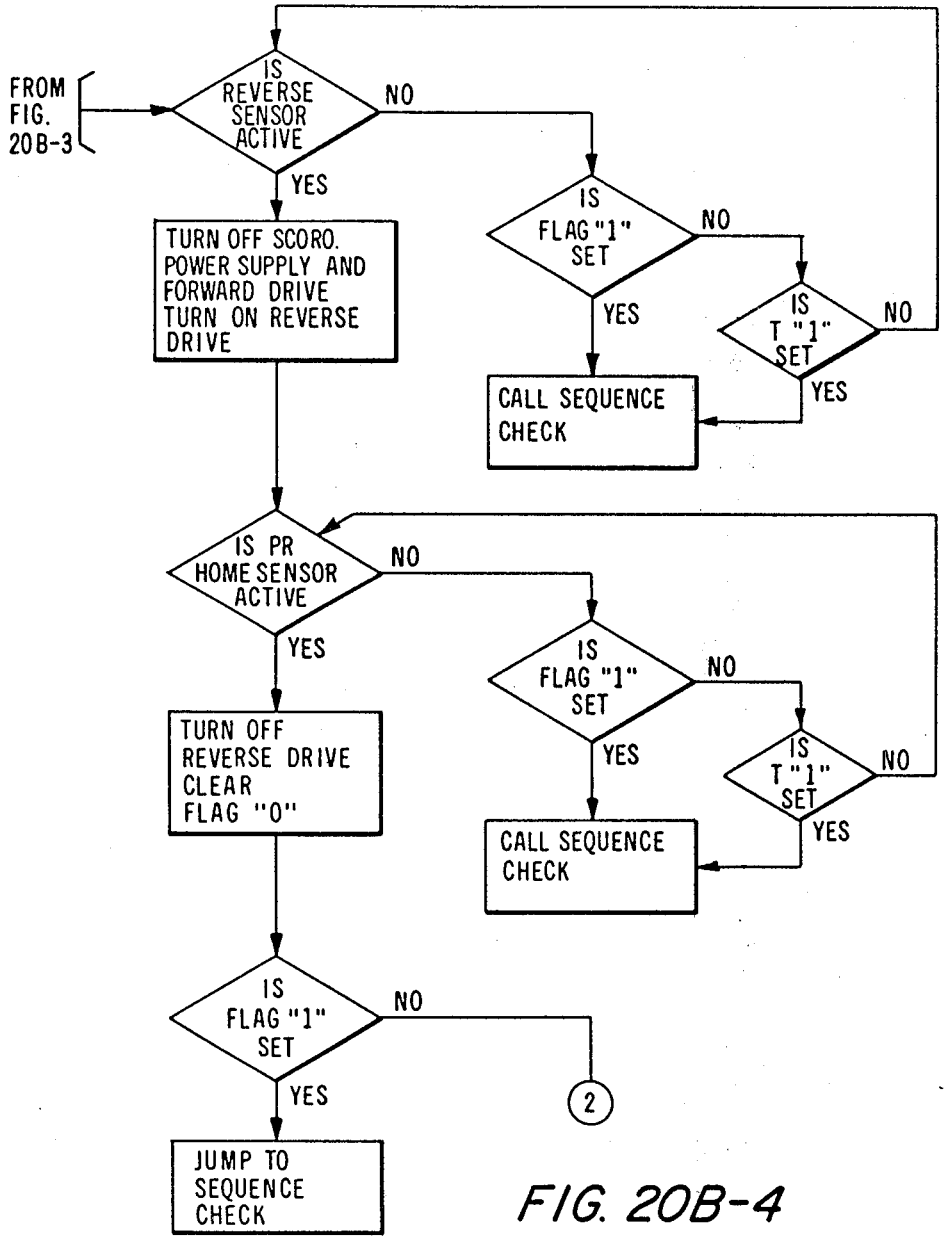
Figure 20C:
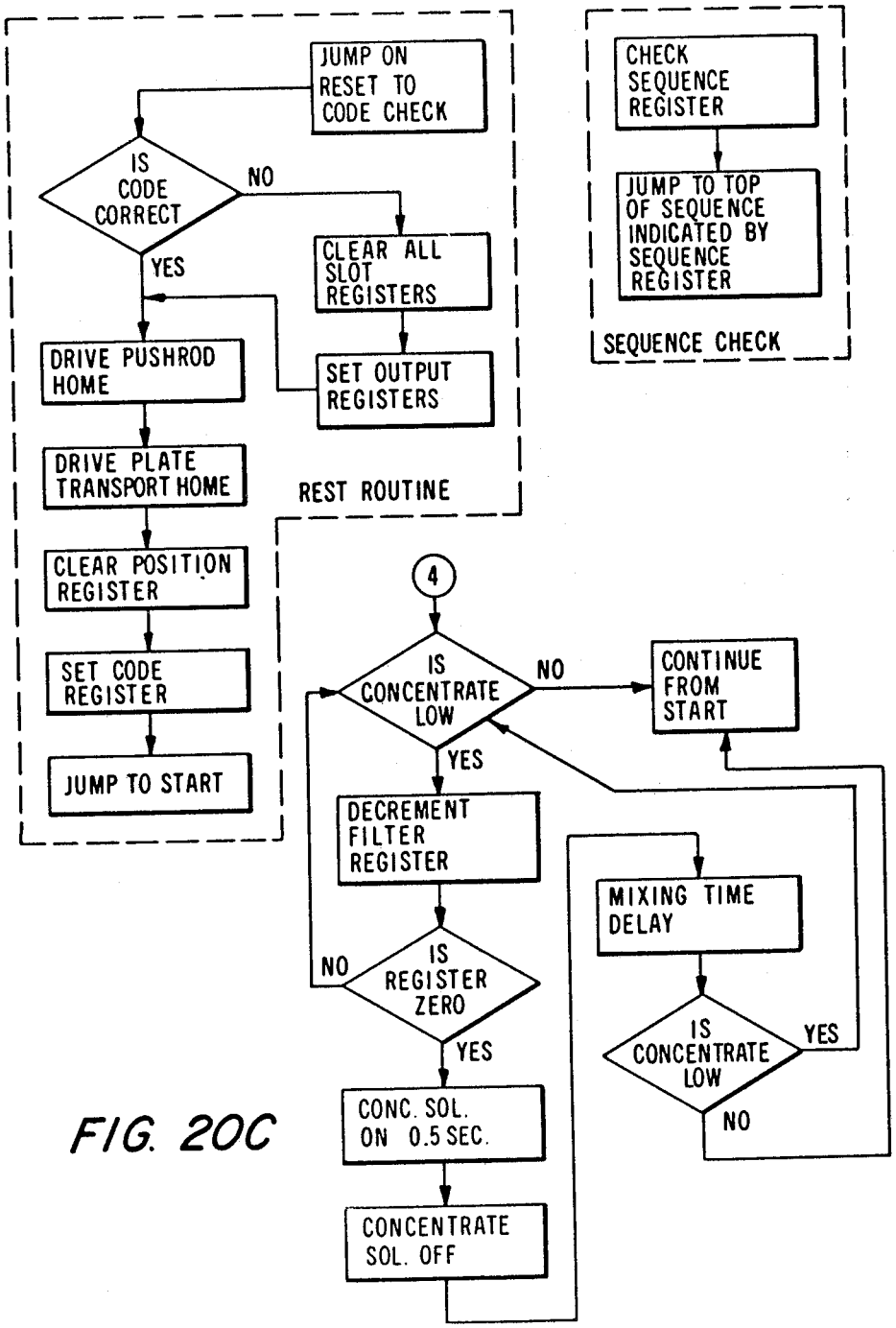

FIGS. 16 and 17, when read together, illustrates the overall processor plate path and shows how a plate 150 is moved from the input station 12 to elevator station 70. FIG. 18 illustrates how pusher mechanism 74 is activated by motor 72 (under control of the microprocessor described with reference to FIG. 19 hereinafter) forces a plate stored in elevator 70 into a carrier portion 170. As shown in FIG. 16, two photosensors 910 and 912 are provided to monitor the position of plate 150 within processor 10. The photosensors, in conjunction with associated light emitting diodes, sense the light reflected from area 162 of the plate (FIG. 5). The status of these photosensors are monitored by the microprocessor and utilized to control various processor components as will be described hereinafter (it should be noted that although five photosensors are illustrated, processor 10 actually utilizes twenty sensors to control machine operation; the photosensors being grouped in either the reflective or interruptive modes of operation).

FIG. 17 further illustrates the cable drive motor 950, a bi-directional type motor which enables the driver mechanism 202 to return to the input station after a plate has been deposited in the elevator. Shaft 952 of motor 950 is coupled to a drive linkage 954 which is utilized to drive pulley 108. Elements 956 and 958 are two additional photosensors which are also utilized to control processing operations in response to the position of plate 150. A cam member 960 is provided in the processor to continuously adjust the tension of the drive cable 102.

The xeroradiographic intraoral dental processor 10 described hereinabove comprises, from an electronic standpoint, five major blocks of circuitry, four of which will not be described in detail for the sake of simplicity. The first block is the power circuitry which comprises AC distribution; a DC high voltage power supply; a multi-output regulated low voltage power supply; a LED constant current source and a standby power source for sustaining CMOS static RAM data. The second block is the sensing and interface circuitry which comprises an input station, output station, and other optoelectronic sensors (reflective and interruptive transducers); tri-state buffers (shown in FIG. 19) for multiplexing sensor outputs, previous plate counter; diagnostic address information to the microcomputer data bus (shown in FIG. 19) and locked rotor (stalled motor) sensing circuits. The third major block is the driver and drive transmission circuitry which comprises motor drivers (on, off, unidirectional and bi-directional NPN drivers), and motors, pump, solenoid, heater, fan and counter. The fourth major block is the control panel and display circuitry which comprises all-effect "Bite-Wing Request", "Tape Cutter Request", and "Previous Plate Request" switches with latching circuits as necessary and a two digit 7-segment LED display with latch/decoder/driver circuits (shown in FIG. 2).

The fifth major block and one which will be described in more detail is the system microcomputer controller circuitry which comprises (see FIG. 19) an 8048/8748 microcomputer 800 MCU (manufactured by the Intel Corporation, Santa Clara, California) with 1K bytes of ROM (internal program memory), 64 bytes of RAM (internal data memory), two 8-bit bi-directional I/O ports 802 and 804, an 8-bit bi-directional data port (data bus) 806, clock/timer/event counter circuitry (internal to MCU 800), an external I/O expander (8355/8755) 810 having two 8-bit bi-directional I/O ports (only port 812 being shown) plus 2K bytes of ROM (external program memory internal to the 8755); and an 8212 address latch 814 to latch address information for the 128 byte 5101L CMOS static RAM (external data memory) 816 and tri-state buffers 818, 820, 822 and 824. Latch 814, RAM 816 blank and decode circuitry 826 functions to drive LED display device 828.

The specifications for the above microprocessor controller components are set forth in "MCS-48 TM Family of Single Chip Microcomputers User's Manual", July, 1978 published by Intel Corporation, the teachings of which that are necessary for an understanding of the present invention being incorporated herein by reference.

The microcomputer system works as follows:

On power-up of the system (provided the ac interlock and circuit breaker are closed), the MCU 800 vectors to its system initialization routines where the following occurs:

(1) A 363 millisecond delay is performed to allow for the settling of power supply voltages and sensor levels.

(2) The 8755 port I/O lines are defined as output and set to the "1" logic state.

(3) The 7-Segment LED displays are blanked (cleared).

(4) The concentrate density status word is cleared.

(5) A "coldstart" is performed whereby the slot registers are cleared, the elevator slots which contain a spacer are so defined, and the slot addresses for the last large plate and last small plate are defined.

(6) The previous plate request counter is reset, the output push-rod 74 is driven home and the input pusher (transport) 202 returns home at two ips, and (7) The tape cutter is driven to its home position.

Following this system initialization, the MCU 800 moves to the start of its mainline program where it now scans looking for either an input request, an output request, a tape cutter request or a concentrate service request.

Input Cycle

When the operator inserts a cassette 16 which contains an exposed plate 150 into the input station slide 22 and pushes the slide in, optoelectronic transducers then sense the presence of a plate at the input and an input request is generated. After receiving an input request, the MCU 800 checks to see if the concentrate density status word is still zero. If the concentrate density status word is not still equal to zero, the MCU 800 goes to the concentrate service routine. Otherwise, the MCU continues with the input request service routines. Another optoelectronic sensor then senses what size the plate is, large or small, and the respective code defining the plate size is written into the plate size register within the MCU 800.

After determining the above, the MCU 800 checks to see if the Bite-Wing latch is set indicating a Bite-Wing request. If the latch was set, the bias voltage is increased 10% (to approximately 1700 V), the transport forward speed is set to one inch/second, the heater, fan, and transport forward drive are then turned on. If the Bite-Wing latch had been reset, the bias voltage would be set to the periapical level (approximately 1550 V), the transport forward speed set to ½ inch/second and the heater, fan and forward drive then turned on. In either case, the plate is removed from the cassette 16 by the input pusher (transport) 202 and is developed and dried as setforth hereinabove. The plate then continues down the plate path towards a speed change position (not shown).

Another optoelectronic transducer senses the plates arrival at the speed change position and the MCU 800 thereafter turns off the high voltage bias, sets the forward plate drive speed to 0.5 inch/second and performs a programmed (202 ms) drying time delay to insure that the toner image is dry on the plate. The plate continues down the plate path and following the drying delay, another optoelectronic transducer senses the plate's arrival at the begin transfer position. At this position, the transport forward speed is increased to 1 inch/second and the heater, fan and transfer motor are turned on. Another optoelectronic transducer which is located at the front of the transfer motor, then senses the beginning of the transfer motor rotation and subsequently the completion of a revolution of the transfer motor shaft after which the MCU 800 turns off the transfer motor and forward transport drive. During this transfer operation, the toner image has been transferred. The single revolution of the transfer motor yields a distance on the tape and paper slightly larger than the actual size of the plate itself.

Following the transfer operation and while the plate is stopped just past the transfer station, the MCU 800 searches the output slot registers to find the most recently emptied slot in elevator 70, drives the stepper motor 950 to position this slot adjacent to the input plate path, and stores this address in memory. After the elevator positioning, the transport forward drive is turned on at 1 inch/second and the cleaning station motor, UV and erase lamps and the fan are turned on. As the plate continues down the input plate path from the transfer station, the MCU 800 looks for another optoelectronic transducer to sense that the plate has reached the cleaning station. During this advancement from transfer station to cleaning station, the processed plate is exposed with UV light to sterilize the plate. Once over the cleaning station, the transport forward drive is turned off for a programmed cleaning delay period (766 ms). When the cleaning delay has elapsed, the fan is turned on for internal system cooling and the transport forward drive is turned on at 1 inch/second. As the plate now advances from the cleaning station towards the elevator, it is exposed by incandescent light from the erase lamp 90. As the plate approaches the entrance to the elevator 70, the MCU 800 looks at another optoelectronic transducer which senses the plate reaching and entering the elevator 70. Once the plate has reached and passed this reverse position (it has thereby been stored within the previously positioned elevator), the MCU 800 turns off the transport forward drive and the fan, as well as the cleaning station motor and UV and erase lamps. Then the tranport reverse drive is turned on with the fan for internal system cooling and after the completion of an exit-from-elevator delay (1 second) the transport 202 returns to its home position, in reverse, at 2 inch/second. Again, an optoelectronic transducer is used to sense the return of the transport 202 to its home position, whereby the MCU 800 turns off the fan and transport reverse drive, clears the input cycle flag, and again returns to the start of its mainline program to again scan for another service request.

Output Cycle

When the operator inserts a cassette 16 into the output station slide 22 and pushes the slide in, an optoelectronic transducer senses this condition and an output request is generated and sent to the MCU 800. The MCU inputs (reads) the status of other optoelectronic transducers to sense which the size carrier 170 was inserted (if any), that the carrier is empty, and that the slide 22 is in the proper latched position. When the status of these three sensors is correct, the MCU 800 searches its data memory (RAM) for the location of the plate (of the size matching that of the present carrier) which has been in the elevator 70 for the longest time, and then drives the elevator positioning stepper motor 850 through port 812 of the 8755 I/O Expander 810 until such time as this plate is positioned adjacent to the empty carrier within the latched output slide. On reaching this position, the MCU 800 drives the output pusher mechanism (through the other port of the 8755 expander 810) forward, moving the plate past the scorotron 23 where it is charged, and then into the waiting empty carrier 170.

The high voltage drive to the scorotron 23 is controlled by port 802. When the charged plate has been fully inserted into the empty carrier, another optoelectronic transducer senses this condition and the MCU 800 then turns off the high voltage, drives the push mechanism 74 in reverse through the other port of the 8755 to its home position as sensed by another optoelectronic transducer, and releases the output slide 22 from its latched position. After removing this charged plate in its carrier from the released output station slide 22, the operator may again repeat the output cycle, as described, until all developed plates have been recharged and removed from the system.

Tape Cutter Request

When the operator pushes the tape cut request switch, this condition is latched in hardware, a LED indicator is lit, and the MCU 800 looks at the latch output. A valid request condition causes the MCU 800 to turn on the transfer motor (paper drive). The MCU 800 then looks at the status from the end-of-transfer optoelectronic transducer to see that the transfer motor begins revolving and subsequently completes two revolutions of the transfer motor shaft before the MCU 800 finally turns off the transfer motor drive. The MCU 800 then drives the tape either forward to its reverse position which again is sensed by another optoelectronic transducer. When the tape cutter reaches the reverse position, the tape cut request LED indicator is extinguished and the tape cutter reverses to its home position. This process yields an image strip approximately twice the length of a plate; namely, half a plate length leader, one plate length image, and finally, half a plate length trailer.

Concentrate Servicing

During "coldstart," the concentrate density status word is cleared. Thereafter, at critical points in the process operation, this density status word is checked to see if the concentrate density is in need of service before a process can begin or be completed.

If when monitored the concentrate density status word is zero, the MCU 800 checks to see if the concentrate density is low. If the density is not low, the MCU 800 verifies that it is correct and returns to the start of the mainline program.

Developer density is monitored from the outputs of a "window comparator" circuit which is driven by the output from a reflective optoelectronic transducer. The monitor operation occurs periodically, the period being on the order of 15 seconds. If the developer density falls below the control point threshold or upper trip point of the window comparator, a solenoid valve 338 is actuated which results in the injection of a unit volume of developer concentrate to the developer housing. This process of monitoring and subsequent concentrate injection continues until the control point threshold is reached, whereby concentrate injection ceases until once again the density falls below the control point threshold. If the density is low, the MCU 800 pulls in the concentrate solenoid 338 to inject toner concentrate for a programmed (15 ms) time and then releases the concentrate solenoid. The concentrate density status word is then set to indicate the injection, and a programmed mixing time delay (5 seconds) is performed. The occurrance of either an output request or tape cut request will interrupt the mixing time delay such that the request is serviced and following, the mixing time delay will restart. Should the concentrate density status word not be equal to zero at the start of the concentrate service routine, the MCU 800 will treat this conditioning as if an injection of toner concentrate had just occurred and operation continues as explained hereinabove.

FIGS. 20(*a*)–20(*c*) are the flow charts describing the operator of the microprocessor controlled processor 10 as set forth hereinabove, the detailed process steps being self-evident from the flow charts.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A xerographic system for developing X-ray sensitive plates of differing sizes enclosed in optically opaque covers comprising:

an input station into which an exposed plate and its cover is inserted comprising means for removing said plate from said cover, a development station for producing an image from said exposed plate onto some recording media, means for storing a plurality of plates of differing sizes, means for charging said plates, an output station into which an empty cover is inserted comprising means for determining the size of said cover, and means for inserting a charged plate into said cover, means for transporting plates through said input station, said development station, means for storing, means for charging and said output station, in that order, and wherein said means for storing is responsive to said output station determining means to supply to the charging means and thereafter to said output station a plate of a size corresponding to that of said cover.

* * * * *